US009570006B2

(12) United States Patent
Song et al.

(10) Patent No.: US 9,570,006 B2
(45) Date of Patent: Feb. 14, 2017

(54) ORGANIC LIGHT-EMITTING DISPLAY DEVICE

(71) Applicant: Samsung Display Co., Ltd., Yongin, Gyeonggi-do (KR)

(72) Inventors: Jae Woo Song, Anyang-si (KR); Jae Hoon Lee, Seoul (KR); Mi Young Kim, Hwaseong-si (KR); Do Hyung Ryu, Yongin-si (KR); Hae Goo Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/513,086

(22) Filed: Oct. 13, 2014

(65) Prior Publication Data

US 2015/0310827 A1 Oct. 29, 2015

(30) Foreign Application Priority Data

Apr. 28, 2014 (KR) ..... 10-2014-0050738

(51) Int. Cl.
*G09G 3/32* (2016.01)
*G09G 3/20* (2006.01)

(52) U.S. Cl.
CPC ..... *G09G 3/3233* (2013.01); *G09G 3/2022* (2013.01); *G09G 2310/0251* (2013.01)

(58) Field of Classification Search
CPC ..... G09G 2310/0245; G09G 2310/0248; G09G 2310/0251; G09G 2320/0223
See application file for complete search history.

(56) References Cited

U.S. PATENT DOCUMENTS

2003/0169219 A1* 9/2003 LeChevalier ..... G09G 3/3216 345/84
2006/0238134 A1* 10/2006 Park ..... G09G 3/3241 315/169.3

(Continued)

FOREIGN PATENT DOCUMENTS

JP 10-143113 A 5/1998
KR 10-2005-0046593 A 5/2005

(Continued)

OTHER PUBLICATIONS

Korean Patent Abstracts No. 10-2004-0087692 A for Patent No. KR 10-0506424 B1, 1 Page.

*Primary Examiner* — Quan-Zhen Wang
*Assistant Examiner* — Dong Hui Liang
(74) *Attorney, Agent, or Firm* — Lewis Roca Rothgerber Christie LLP

(57) ABSTRACT

An organic light-emitting display device which divides each frame into a plurality of sub-frames and represents gray levels based on the sum of the lengths of one or more sub-frames during which light is emitted, the organic light-emitting display device comprising a display unit including a plurality of pixels arranged in a matrix, a scan driver configured to provide a scan signal to the display unit during each sub-frame period and a precharge voltage unit configured to provide a precharge voltage to the pixels, wherein the pixels are divided into a first pixel column block including a pixel receiving the scan signal before the other pixels and a second pixel column block next to the first pixel column block in a direction of the application of the scan signal and the precharge voltage is selectively provided to pixels included in the first pixel column block.

20 Claims, 15 Drawing Sheets

(56) References Cited

U.S. PATENT DOCUMENTS

| | | | | |
|---|---|---|---|---|
| 2008/0170011 | A1* | 7/2008 | Kohno | G09G 3/3233 345/77 |
| 2008/0238912 | A1* | 10/2008 | Aoki | G09G 3/3648 345/215 |
| 2008/0316232 | A1* | 12/2008 | Ryu | G09G 3/204 345/690 |

FOREIGN PATENT DOCUMENTS

| | | | |
|---|---|---|---|
| KR | 10-0506424 | B1 | 8/2005 |
| KR | 10-2008-0001332 | A | 1/2008 |

* cited by examiner

ORGANIC LIGHT-EMITTING DISPLAY DEVICE

CROSS-REFERENCE TO RELATED APPLICATION

This application claims priority to and the benefit of Korean Patent Application No. 10-2014-0050738 filed on Apr. 28, 2014 in the Korean Intellectual Property Office, the disclosure of which is incorporated herein by reference in its entirety.

BACKGROUND

1. Field

The invention relates to an organic-light emitting display device.

2. Description of the Related Art

Organic light-emitting display devices, which are self-light-emitting display devices, have been in the spotlight as next-generation display devices because they provide high luminance, require low driving voltages, and can be made to be ultra-thin. In the meantime, in an analog driving method, which is generally applied to organic light-emitting display devices, a grayscale is represented by controlling the amount of current flown into each organic light-emitting element. The characteristics of a driving transistor for driving an organic light-emitting element in each pixel may vary due to process variations, and thus, the amount of light emitted by an organic light-emitting element may vary from one pixel to another pixel even in response to the same amount of current being flown into each pixel. To address this problem, attempts have been made to apply a digital driving method to organic light-emitting display devices. In the digital driving method, a single frame may be divided into a plurality of sub-frames having different lengths, which can each be represented as $2^n$, and a grayscale (e.g., gray levels) can be represented based on the sum of the lengths of one or more sub-frames during which light is emitted.

However, as the size, resolution, and display quality of organic light-emitting display devices increase, the number of sub-frames required may also increase considerably. However, as the number of sub-frames of each frame increases, the amount of time that it takes to scan for each sub-frame decreases. As a result, each pixel may not be able to be fully charged with a data voltage, thereby resulting in a deteriorated quality of display. To improve the efficiency of charging each pixel with a data voltage, a precharge driving method has been developed in which a precharge voltage is applied, ahead of a data voltage, to each pixel of an organic light-emitting display device.

However, the amount of improvement of the charging characteristics of pixels by the precharge driving method may vary considerably from one position to another position in an organic light-emitting display device. Also, the supply of the precharge voltage to all pixels may result in a considerable increase in the power consumption of an organic light-emitting display device.

SUMMARY

Example embodiments of the present invention provide an organic light-emitting display device, which can effectively provide a precharge voltage in consideration of the charging characteristics of each pixel and can thus consume less power.

However, example embodiments of the invention are not restricted to those set forth herein. The above and other example embodiments of the invention will become more apparent to one of ordinary skill in the art to which the invention pertains by referencing the detailed description of the invention given below.

According to an example embodiment of the present invention, an organic light-emitting display device which divides each frame into a plurality of sub-frames and represents gray levels based on a sum of lengths of one or more of the plurality of sub-frames during which light is emitted, the organic light-emitting display device including: a display unit including a plurality of pixels arranged in a matrix; a scan driver configured to provide a scan signal to the display unit during each sub-frame period; and a precharge voltage unit configured to provide a precharge voltage to the pixels, wherein the pixels are divided into a first pixel column block including a pixel configured to receive the scan signal before other pixels receive the scan signal, and a second pixel column block next to the first pixel column block in a direction of an application of the scan signal, and the precharge voltage is selectively provided to pixels in the first pixel column block.

The first pixel column block includes a plurality of scan lines extending in a first direction and configured to apply the scan signal to each of the pixels in the first pixel column block, and a plurality of data lines extending in a second direction crossing the first direction, and configured to transmit a data voltage to each of the pixels in the first pixel column block and the precharge voltage unit is configured to provide the precharge voltage to the data lines before the data voltage is applied to the data lines.

The precharge voltage unit is further configured to provide different precharge voltages to the data lines.

A duration of the precharge voltage provided to the data lines decreases at a predetermined rate along the first direction.

The precharge voltage provided to the data lines decreases at a predetermined rate along the first direction.

The display unit further includes a plurality of scan lines, and the scan driver includes a first scan driver configured to provide the scan signal to odd-numbered scan lines among the scan lines, and a second scan driver configured to provide the scan signal to even-numbered scan lines among the scan lines, and the first scan driver and the second scan driver are configured to be alternately activated and apply the scan signal in opposite directions.

The precharge voltage unit includes a first precharge voltage unit configured to provide the precharge voltage to pixels in the first pixel column block in response to the first scan driver being activated, and a second precharge voltage unit configured to provide the precharge voltage to pixels in the first pixel column block in response to the second scan driver being activated.

According to another example embodiment of the present invention, an organic light-emitting display device is described which divides each frame into a plurality of sub-frames and represents gray levels based on a sum of lengths of one or more of the plurality of sub-frames during which light is emitted, the organic light-emitting display device including: a display unit comprising a plurality of pixels arranged in a matrix; a scan driver configured to provide a scan signal to the display unit during each sub-frame period; and a precharge voltage unit configured to provide a precharge voltage to the pixels, wherein the pixels are divided into a first pixel column block including a pixel configured to receive the scan signal before other pixels receive the scan signal, and a second pixel column block next to the first pixel column block in a direction of an application of the scan signal, the precharge voltage including a first precharge voltage configured to be provided to the first pixel column block and a second precharge voltage configured to be provided to the second pixel column block, and the first precharge voltage is higher than the second precharge voltage.

The scan driver includes a first scan driver configured to provide the scan signal to odd-numbered scan lines and a second scan driver configured to provide the scan signal to even-numbered scan lines, and the first scan driver and the second scan driver are configured to be alternately activated and apply the scan signal in opposite directions.

The first pixel column block and the second pixel column block are reset depending on which of the first scan driver and the second scan driver is activated, and the precharge voltage unit is configured to provide the first precharge voltage and the second precharge voltage to reset the first and second pixel column blocks, respectively.

The display unit further includes a plurality of scan lines extending in a first direction and configured to apply the scan signal to each of the pixels in the first pixel column block, and a plurality of data lines extending in a second direction crossing the first direction, and configured to transmit a data voltage to each of the pixels in the first pixel column block and the precharge voltage unit is configured to provide the precharge voltage to the data lines before the data voltage is applied to the data lines.

The first precharge voltage unit is configured to provide different first precharge voltages to data lines in the first pixel column block.

A voltage level of each first precharge voltage provided to the data lines decreases at a predetermined rate along the first direction, and a lowest first precharge voltage is higher than the second precharge voltage.

A duration of each precharge voltage provided to the data lines decreases at a predetermined rate along the first direction.

An organic light-emitting display device which divides each frame into a plurality of sub-frames and represents gray levels based on a sum of lengths of one or more of the plurality of sub-frames during which light is emitted, the organic light-emitting display device including: a display unit including a plurality of pixels arranged in a matrix, each pixel of the pixels including an organic light-emitting element and a driving transistor configured to drive the organic light-emitting element; a scan driver configured to provide a scan signal to the display unit during each sub-frame period; and a data driver configured to provide an ON voltage to turn on the driving transistor, wherein the pixels are divided into a first pixel column block including a pixel configured to receive the scan signal before other pixels receive the scan signal, and a second pixel column block next to the first pixel column block in a direction of an application of the scan, the data driver configured to provide a first ON voltage with a first voltage level to the first pixel column block and a second ON voltage with a second voltage level, which is lower than the first level, to the second pixel column block.

The scan driver includes a first scan driver configured to provide the scan signal to odd-numbered scan lines and a second scan driver configured to provide the scan signal to even-numbered scan lines, and the first scan driver and the second scan driver are configured to be alternately activated and apply the scan signal in opposite directions.

The first pixel column block and the second pixel column block are reset depending on which of the first scan driver and the second scan driver is activated, and the data driver is configured to provide the first ON voltage and the second ON voltage to reset the first and second pixel column blocks, respectively.

The first pixel column block includes a plurality of scan lines extending in a first direction and is configured to apply the scan signal to each of the pixels included in the first pixel column block, and a plurality of data lines extending in a second direction, which crosses the first direction, and configured to transmit a data voltage to each of the pixels included in the first pixel column block.

The data driver is configured to provide different first ON voltages to the data lines.

A voltage level of each first ON voltage decreases at a predetermined rate along the first direction, and a lowest first ON voltage is higher than a second precharge voltage.

According to the example embodiments, it is possible to effectively provide a precharge voltage in consideration of the charging characteristics of each pixel. Accordingly, it is possible to improve the quality of display and reduce the power consumption of an organic light-emitting display device.

Other features and example embodiments will be apparent from the following detailed description, the drawings, and the claims.

DETAILED DESCRIPTION

Figure 1:
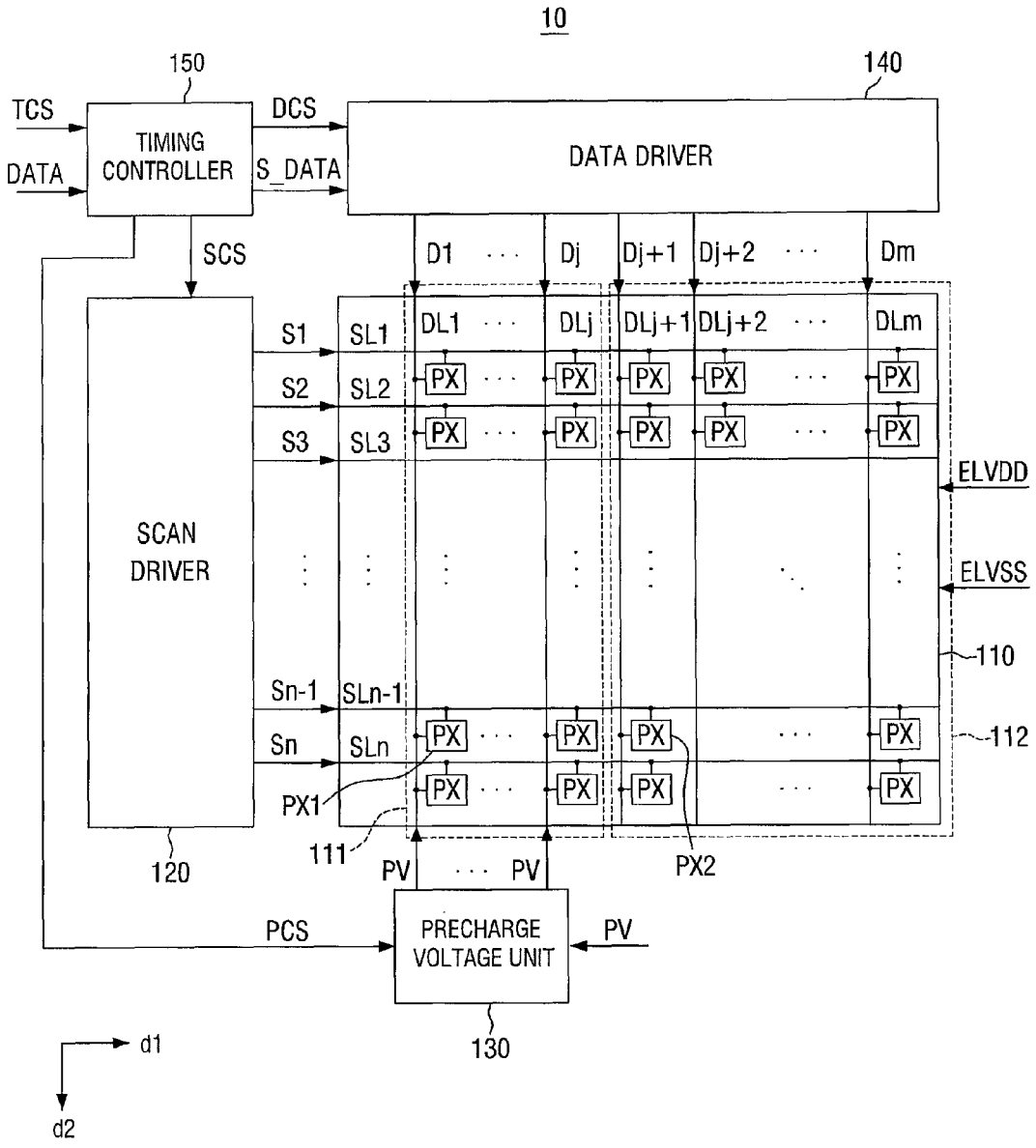
FIG. 1 is a block diagram illustrating an organic light-emitting display device according to an example embodiment of the present invention.

The aspects and features of the present invention and methods for achieving the aspects and features will be apparent by in reference to the embodiments to be described in detail with reference to the accompanying drawings. However, the present invention is not limited to the embodiments disclosed hereinafter, but can be implemented in diverse forms. The matters defined in the description, such as the detailed construction and elements, are specific example details provided to assist those of ordinary skill in the art with a comprehensive understanding of the invention, and the present invention is defined by the scope of the appended claims and their equivalents.

The term "on" that is used to designate that an element is on another element or located on a different layer or a layer includes both a case where an element is located directly on another element or a layer and a case where an element is located on another element via another layer or still another element. When a first element is described as being "connected" or "coupled" to a second element, the first element may be directed connected or coupled to the second element, or indirectly connected or coupled to the second element via one or more other elements interposed therebetween. In the entire description of embodiments of the present invention, the same drawing reference numerals are used for the same elements across various figures.

Although the terms "first, second, and so forth" are used to describe diverse constituent elements, such constituent elements are not limited by the terms. The terms are used only to discriminate a constituent element from other constituent elements. Accordingly, in the following description, a first constituent element may alternatively be referred to as a second constituent element.

Example embodiments of the present invention will be described hereinafter with reference to the accompanying drawings.

Figure 2:
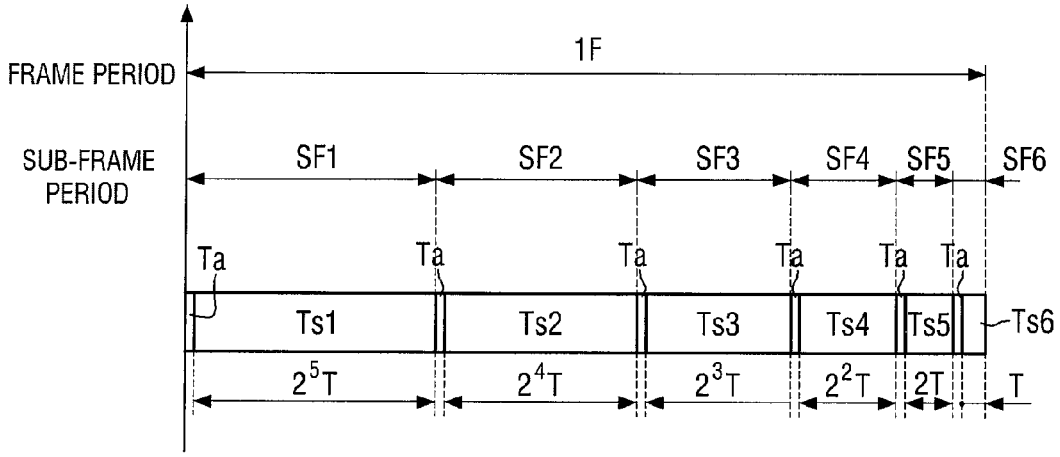
FIG. 2 is a schematic diagram illustrating a plurality of sub-frames.
Figure 3:
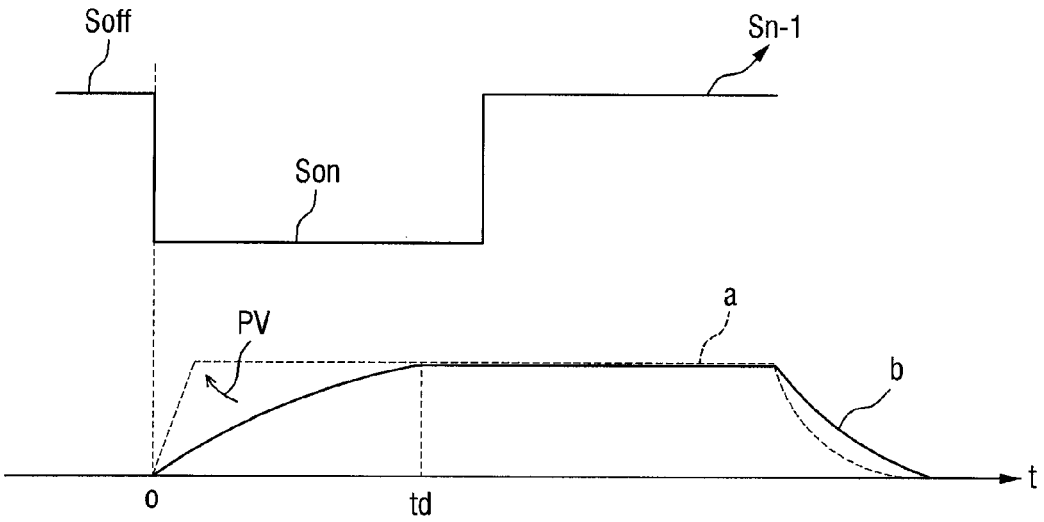
FIG. 3 is a graph illustrating the relationship between a scan signal applied to a first pixel column block and a data voltage.
Figure 4:
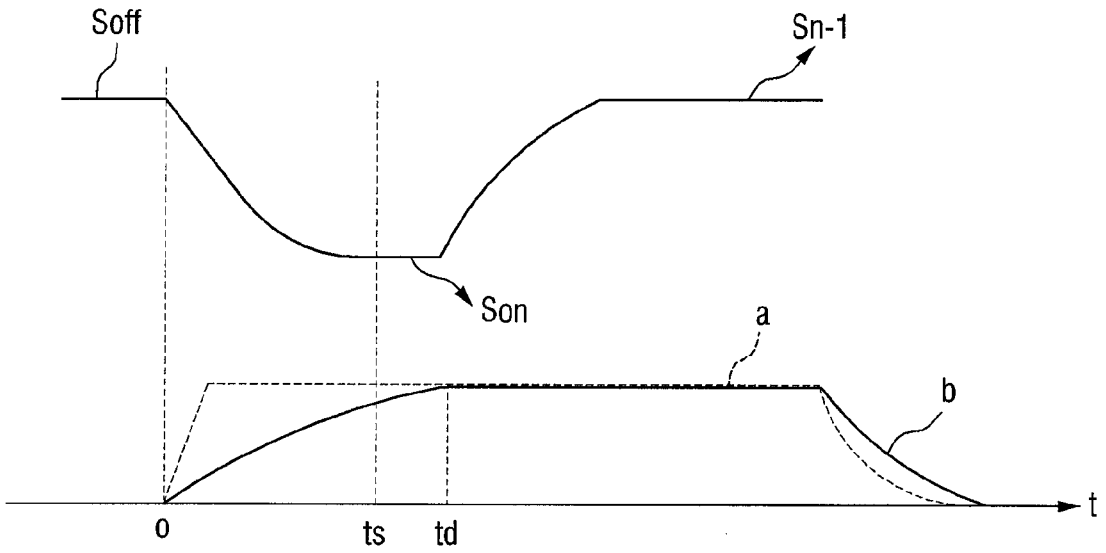
FIG. 4 is a graph illustrating the relationship between a scan signal applied to a second pixel column block and the data voltage.

FIG. 1 is a block diagram illustrating an organic light-emitting display device (e.g., organic light-emitting diode (OLED) display device) according to an example embodiment of the present invention, FIG. 2 is a schematic diagram illustrating a plurality of sub-frames, FIG. 3 is a graph illustrating the relationship between a scan signal applied to a first pixel column block and a data voltage, and FIG. 4 is a graph illustrating the relationship between a scan signal applied to a second pixel column block and the data voltage.

Referring to FIGS. 1 to 4, an organic light-emitting display device 10 includes a display unit 110, a scan driving unit (e.g., a scan driver) 120, and a precharge voltage unit 130.

The display unit 110 may be a region where images are displayed. The display unit 110 may include a plurality of scan lines SL1, SL2, . . . , SLn, a plurality of data lines DL1, DL2, . . . , DLm crossing the scan lines SL1, SL2, . . . , SLn, and a plurality of pixels PX coupled to the scan lines SL1, SL2, . . . , SLn and to the data lines DL1, DL2, . . . , DLm. The scan lines SL1, SL2, . . . , SLn may extend in a first direction d1, and may be substantially parallel with one another. The scan lines SL1, SL2, . . . , and SLn may include first through n-th scan lines SL1 through SLn that are sequentially arranged. The data lines DL1, DL2, . . . , DLm may cross the scan lines SL1, SL2, . . . , SLn. That is, the data lines DL1, DL2, . . . , DLm may extend in a second direction d2, which is perpendicular to the first direction d1, and may be substantially parallel with one another. The first direction d1 may correspond to a row direction, and the second direction d2 may correspond to a column direction.

The pixels PX may be arranged in a matrix. Each of the pixels PX may be coupled to one of the scan lines SL1, SL2, . . . , SLn and one of the data lines DL1, DL2, . . . , DLm. Each of the pixels PX may receive one of a plurality of scan signals S1, S2, . . . , Sn from one of the scan lines SL1, SL2, . . . , SLn coupled thereto and may receive one of a plurality of data voltages D1, D2, . . . , Dm from one of the data lines DL1, DL2, . . . , DLm coupled thereto in response to the receipt of one of the scan signals S1, S2, . . . , Sn. Each of the pixels PX may be provided with a first power voltage ELVDD via a first power line, and may be provided with a second power voltage ELVSS via a second power line.

Each of the pixels PX may include a driving transistor and an organic light-emitting element. The driving transistor may drive the organic light-emitting element to emit light with a predetermined luminance level according to a data voltage applied to the driving transistor. The organic light-emitting element may emit light for each of a plurality of sub-frames of a frame, and a grayscale may be represented based on the sum of the lengths of one or more sub-frames when the organic light-emitting element emits light.

As illustrated in FIG. 2, a single frame 1F may be divided into a plurality of sub-frames SF1, SF2, . . . , SF6. The single frame 1F may represent a period during which each pixel PX displays an image. In an example embodiment, the number of sub-frames of the single frame 1F may be 6, as illustrated in FIG. 2, but the invention is not limited thereto. That is, in an alternative example embodiment, the number of sub-frames of the single frame 1F may be 8 or greater. Each of the sub-frames SF1, SF2, . . . , SF6 may include an address period Ta. The sub-frames SF1, SF2, . . . , SF6 may also include a plurality of sustain periods Ts1, Ts2, . . . , Ts6, respectively. The address periods Ta of the sub-frames SF1, SF2, . . . , SF6 are periods for applying the data voltages D1, D2, . . . , Dm to all the pixels PX, and may correspond to a scan-on period of a scan signal. The address periods Ta of the sub-frames SF1, SF2, . . . , SF6 may have the same length.

The sustain periods Ts1, Ts2, . . . , Ts6 may be periods during which an organic light-emitting element emits light in response to receipt of one of the data voltages D1, D2, . . . Dm. The data voltages D1, D2, . . . , Dm may be digital signals transmitting a data vale of "1" or "0". That is, each of the data voltages D1, D2, . . . , Dm may be either a first voltage with a first level that corresponds to a data value of "1" and can turn on a driving transistor or a second voltage with a second level that corresponds to a data value of "0" and can turn off a driving transistor. In response to the first voltage being applied to an organic light-emitting element as a data voltage, the organic light-emitting element may emit light with a predetermined luminance level during the sustain periods Ts1, Ts2, . . . , Ts6. On the other hand, in response to the second voltage being applied to an organic light-emitting element as a data voltage, the organic light-emitting element may not emit light during the sustain periods Ts1, Ts2, . . . , Ts6.

The sub-frames SF1, SF2, . . . , SF6 may have different lengths from one another. More specifically, the length of each of the sustain periods Ts1, Ts2, . . . , Ts6 may be $2^n$, and the sustain periods Ts1, Ts2, . . . , Ts6 may have different "n" values from one another. For example, the first sustain period Ts1 and the second sustain period Ts2 may be $2^5$T and $2^4$T, respectively, where T is an integer greater than 0, and the ratio between the sustain periods Ts1, Ts2, . . . , Ts6 may be $2^5:2^4:2^3:2^2:2:1$. That is, the length of each sustain period may decrease over time within the length of a whole frame 1F, but the invention is not limited thereto. In an alternative example, the length of each sustain period may increase over time within the length of a whole frame 1F. A grayscale of the single frame 1F may be determined by summing up the lengths of the sustain periods Ts1, Ts2, . . . , Ts6 multiplied by the data voltages respectively applied during the sustain periods Ts1, Ts2, . . . , Ts6. To represent a grayscale of 34, the first voltage, which corresponds to a data value of "1", may be applied, as a data voltage, to the address periods Ta of the first and fifth sub-frames SF1 and SF5 such that an organic light-emitting element can emit light with a predetermined luminance during each of the first and fifth sustain periods Ts1 and Ts5, and the second voltage, which corresponds to a data value of "0", may be applied, as a data voltage, to the address periods Ta of the other sustain periods, i.e., the second, third, fourth and sixth sustain periods Ts2, Ts3, Ts4 and Ts6, such that the organic light-emitting element cannot emit light during the second, third, fourth and sixth sustain periods Ts2, Ts3, Ts4 and Ts6.

The scan driving unit 120 may provide the scan signals S1, S2, . . . , Sn to the scan lines SL1, SL2, . . . , SLn, respectively, of the display unit 110 during the period of each of the sub-frames SF1, SF2, . . . , SF6. Each of the scan signals S1, S2, . . . , Sn may include a scan-on period providing a scan-on voltage Son with a first level, and a scan-off period providing a scan-off voltage Soff with a second level. As already mentioned above, each of the address periods Ta of the sub-frames SF1, SF2, . . . , SF6 may correspond to the scan-on period of a scan signal, and each of the sustain periods Ts1, Ts2, . . . , Ts6 may correspond to the scan-off period of a scan signal.

The precharge voltage unit 130 may provide a precharge voltage PV to the pixels PX. The precharge voltage PV, which has a predetermined level, may be provided, ahead of (or before) the data voltages D1, D2, . . . , Dm, to the data lines DL1, DL2, . . . , DLm so that the data lines DL1, DL2, . . . , DLm can be precharged. Accordingly, it is possible for example, to reduce the occurrence of an "RC delay" phenomenon in which the pixels PX are not sufficiently charged with the data voltages D1, D2, . . . , Dm during a short address period Ta of each sub-frame. The precharge voltage unit 130 may selectively provide the precharge voltage PV to only some of the pixels PX of the display unit 110.

The pixels PX of the display unit 110 may be divided into a first pixel column block 111 and a second pixel column block 112. The first pixel column block 111 and the second pixel column block 112 may be arranged side-by-side in a direction in which the scan signals S1, S2, . . . , Sn are transmitted. The second pixel column block 112 may be arranged next to (or adjacent) the first pixel column block 111. The first pixel column block 111 may receive the scan signals S1, S2, . . . , Sn earlier than the second pixel column block 112, and may be nearer to the scan driving unit 120. The first pixel column block 111 may include a pixel PX which receives a scan signal ahead of (or before) other pixels PX, e.g., a pixel PX belonging to a first row and a first column of the matrix of the pixels PX. In an example embodiment, the first pixel column block 111 may include first through j-th columns of pixels PX, which are coupled to the first through j-th data lines DL1 through DLj, respectively, and the second pixel column block 112 may include the (j+1)-th through m-th columns of pixels PX, which are coupled to the (j+1)-th through m-th data lines DLj+1 through DLm, respectively. However, the invention is not limited to this example embodiment. The precharge voltage unit 130 may selectively provide the precharge voltage PV only to the first pixel column block 111.

FIG. 3 is a graph illustrating the relationship between an (n−1)-th scan signal Sn−1 applied to a first pixel PX1, which is coupled to an (n−1)-th scan line SLn−1 and the first data line DL1, and the data voltage D1 that the first pixel PX1 is charged with, and FIG. 4 is a graph illustrating the relationship between the (n−1)-th scan signal Sn−1 also applied to a second pixel PX2, which is coupled to the (n−1)-th scan line SLn−1 and a (j+1)-th data line DLj+1, and the data voltage Dj+1 that the second pixel PX2 is charged with.

Referring to FIGS. 3 and 4, because the first pixel column block 111 is adjacent and/or near the scan driving unit 120, only a relatively small RC delay, if any, may be generated in the transmission of the (n−1)-th scan signal Sn−1 to the first pixel PX1 due to the resistance of the (n−1)-th scan line SLn−1, and as a result, only a relatively small delay, if any, may occur in the transition of the (n−1)-th scan signal Sn−1 from the level of the scan-off voltage Soff to the level of the scan-on voltage Son. An RC delay in the transmission of the first data voltage D1 to the first pixel PX1 may occur due to the resistance of the first data line DL1, and as a result, as much time as a first time delay td may be needed to charge the first pixel PX up to a predetermined voltage. An ideal pattern (a) of the charging of the first pixel PX1 with the first data voltage D1 may differ from an actual pattern (b) of the charging of the first pixel PX1 with the first data voltage D1. Due to a data voltage charging delay in the first pixel PX1, the quality of display at the first pixel PX1 may deteriorate.

Because the second pixel column block 112, unlike the first pixel column block 111, is located apart (or relatively farther) from the scan driving unit 120, an RC delay in the transmission of the (n−1)-th scan signal Sn−1 to the second pixel PX2 may occur due to the resistance of the (n−1)-th scan line SLn−1. That is, the transition of the (n−1)-th scan signal Sn−1 from the level of the scan-off voltage Soff to the level of the scan-on voltage Son may not readily occur, and the (n−1)-th scan signal Sn−1 may drop to the level of the scan-on voltage Son after a second time delay ts. An RC delay may also be generated in the transmission of the (j+1)-th data voltage Dj+1 to the second pixel PX2 due to the resistance of the (j+1)-th data line DLj+1, and thus, as much time as the first time delay td may be needed to charge the second pixel PX2 up to a predetermined voltage. At a time ts when the second pixel PX2 is turned on, the ideal amount by which the second pixel PX2 is charged with the (j+1)-th data voltage Dj+1 may not differ by much from the actual amount by which the second pixel PX2 is charged with the (j+1)-th data voltage Dj+1. That is, since the charging of the second pixel PX2 with the (j+1)-th data voltage Dj+1 is delayed as much as the transition of the (n−1)-th scan signal Sn−1 to the scan-on voltage Son, the quality of display at the second pixel PX2 may not deteriorate by much regardless of a data voltage charging delay in the second pixel PX2.

The precharge voltage unit 130 may selectively provide the precharge voltage PV only to the first pixel column block 111 where the quality of display may considerably deteriorate due to a data voltage charging delay. Accordingly, because the first through j-th data lines DL1 through DLj, which are coupled to the first pixel column block 111, can be charged with the precharge voltage PV, the pixels PX in the first pixel column block 111 can be effectively charged with a data voltage, and as a result, the quality of display in the first pixel column block 111 can be prevented or reduced from deteriorating due to a data voltage charging delay in the first pixel column block 111. The organic light-emitting display device 10 can selectively provide the precharge voltage PV in consideration of the data voltage charging properties of each part of the display unit 110, and can thus effectively lower its power consumption in connection with the provision of the precharge voltage PV.

Referring back to FIG. 1, the organic light-emitting display device 10 may also include a data driving unit (e.g., data driver) 140 and a timing control unit (e.g., a timing controller) 150.

The timing control unit 150 may receive a timing control signal TCS and image data DATA from an external system. The timing control signal TCS may be a vertical synchronization signal Vsync, a horizontal synchronization signal Hsync, a data enable signal DE, or a clock signal CLK. The timing control unit 150 may generate a scan control signal SCS for controlling the scan driving unit 120 and a data control signal DCS for controlling the data driving unit 140 based on the timing control signal TCS. The data control signal DCS may be, for example, a source start pulse SSP, a source sampling clock SSC, or a source output enable signal SOE. The scan control signal SCS may be a gate start pulse GSP or a gate sampling clock GSC.

The timing control signal TCS may be the vertical synchronization signal Vsync, the horizontal synchronization signal Hsync, the data enable signal DE, or the clock signal CLK. The timing control unit 150 may also generate a precharge control signal PCS for controlling the precharge voltage unit 130, and may provide the precharge control signal PCS to the precharge voltage unit 130.

The timing control unit 150 may convert the image data into sub-image data S_DATA, The image data DATA may be an image signal corresponding to a single frame, and the sub-image data S_DATA may be an image signal corresponding to each sub-frame of a frame. The timing control unit 150 may generate the sub-image data S_DATA by mapping the image data DATA between a plurality of sub-frames SF1 through SF6 of a frame. The timing control unit 150 may output the data control signal DCS and the sub-image data S_DATA to the data driving unit 140.

The data driving unit 140 may receive the data control signal DCS and the sub-image data S_DATA from the timing control unit 150. The data driving unit 140 may convert the sub-image data S_DATA according to the data control signal DCS and may thus generate the data voltages D1, D2, . . . , Dm. The data driving unit 140 may output the data voltages D1, D2, . . . , Dm to the display unit 110. The data driving unit 140 may output the first through j-th data voltages D1 through Dj to the display unit 110 after the application of the precharge voltage PV to the display unit 110. The structures of the data driving unit 140 and the precharge voltage unit 130 will hereinafter be described with reference to FIGS. 5 to 7.

Figure 5:
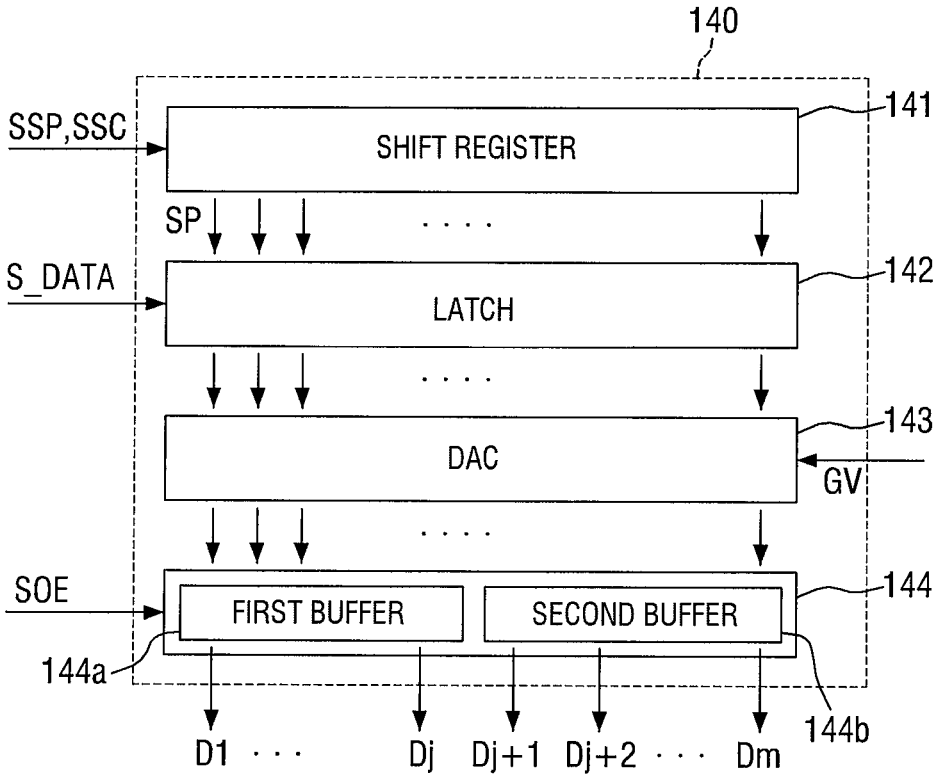
FIG. 5 is a block diagram illustrating a data driving unit according to an example embodiment of the present invention.
Figure 6:
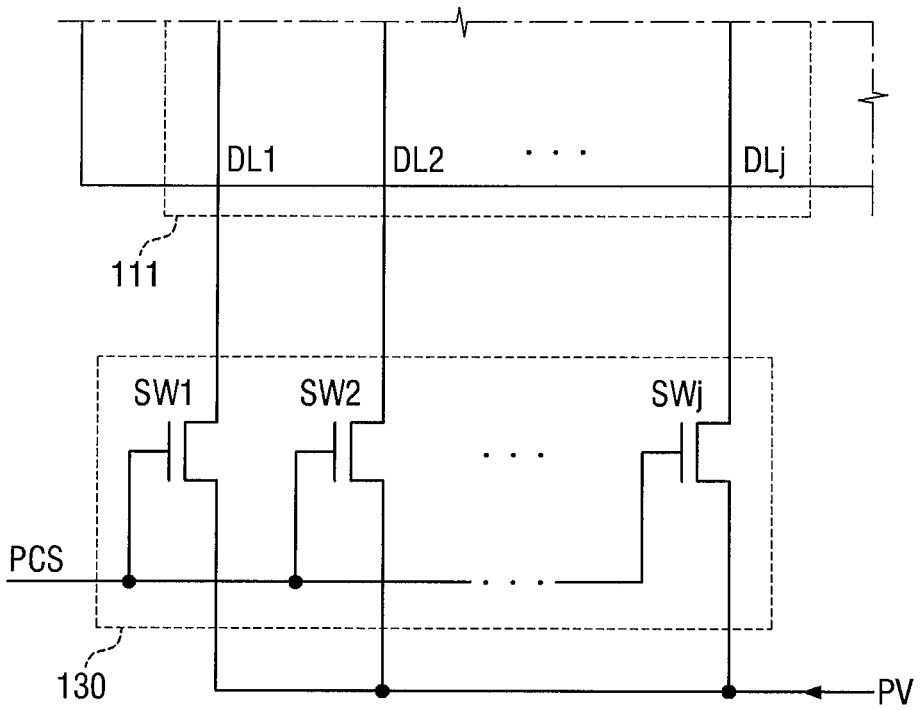
FIG. 6 is a circuit diagram illustrating a precharge voltage unit according to an example embodiment of the present invention.
Figure 7:
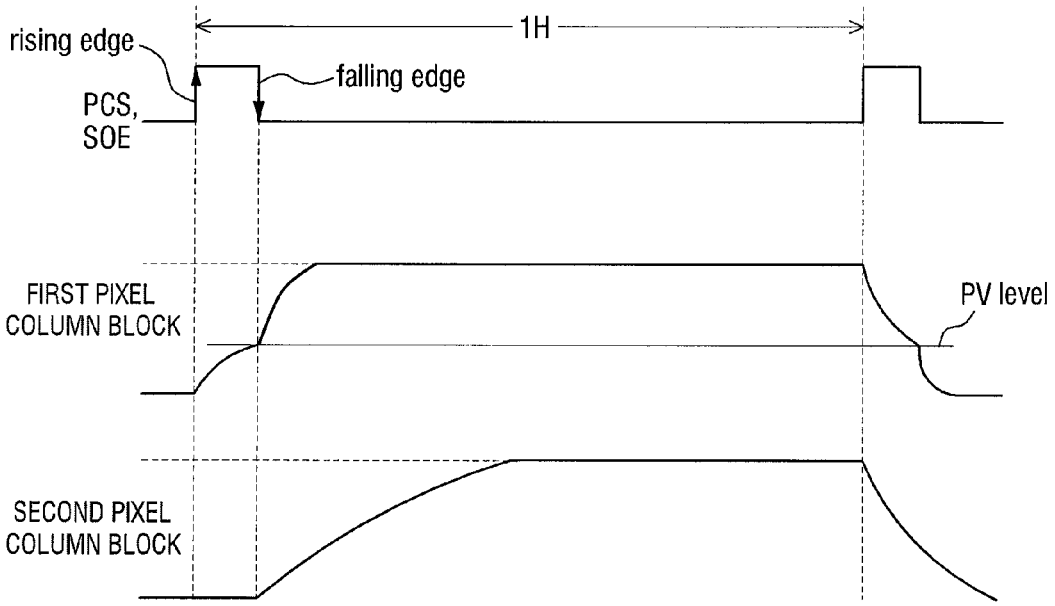
FIG. 7 is a waveform diagram illustrating the variation of a voltage applied to the data lines of the first and second pixel column blocks in accordance with an output signal.

FIG. 5 is a block diagram illustrating a data driving unit according to an example embodiment of the invention, FIG. 6 is a circuit diagram illustrating a precharge voltage unit according to an example embodiment of the invention, and FIG. 7 is a waveform diagram illustrating the variation of a voltage applied to the data lines of first and second pixel column blocks in accordance with an output signal.

Referring to FIGS. 5 to 7, the data driving unit 140 may include a shift register 141, a latch 142, a digital-to-analog converter ("DAC") 143 and a buffer 144. The shift register 141 may receive the data control signal DCS. The shift register 141 may generate a sampling signal SP by shifting the source start pulse SSP in accordance with the source sampling clock SSC, and may provide the sampling signal SP to the latch 142.

The latch 142 may receive the sampling signal SP from the shift register 141, and may receive the sub-image data S_DATA from the timing control unit 150. The latch 142 may sequentially latch the sub-image data S_DATA in accordance with the sampling signal SP, and may provide the sequentially-latched sub-image data S_DATA.

The DAC 143 may generate the data voltages D1, D2, . . . , Dm by converting the sub-image data S_DATA based on a grayscale reference voltage GV provided by a voltage generation unit, and may provide the data voltages D1, D2, . . . , Dm to the buffer 144.

The buffer 144 may provide the data voltages D1, D2, . . . , Dm to the display unit 110. The buffer 144 may include a first buffer 144*a*, which outputs the first through j-th data voltages D1 through Dj that are to be provided to the first pixel column block 111, and a second buffer 144*b*, which output the (j+1)-th through m-th data voltages Dj+1 through Dm that are to be provided to the second pixel column block 112. The first buffer 144*a* and the second buffer 144*b* may be independent source integrated chips ("iCs"), but the invention is not limited thereto. The first buffer 144*a* and the second buffer 144*b* may output the first through j-th data voltages D1 through Dj and the (j+1)-th through m-th data voltages Dj+1 through Dm, respectively, in accordance with the falling edge of the source output enable signal SOE.

The precharge voltage unit 130 may receive the precharge voltage PV from the voltage generation unit and may receive the precharge control signal PCS from the timing control unit 150. The precharge voltage PV may be a static voltage with a predetermined level. The precharge control signal PCS may be a signal for controlling the output timing of the precharge voltage PV. The precharge voltage unit 130 and the data driving unit 140 may be located on opposite sides of the display unit 110. That is, the data driving unit 140 and the precharge voltage unit 130 may be located at the top and the bottom (or vice versa), respectively, of the display unit 110 or on the left and right sides (or vice versa), respectively, of the display unit 110, and may apply the data voltages D1, D2, . . . , Dm and the precharge voltage PV, respectively, in opposite directions. However, the invention is not limited to this. That is, the precharge voltage unit 130 and the data driving unit 140 may be located on the same side of the display unit 110, and may apply the precharge voltage PV and the data voltages D1, D2, . . . , Dm, respectively, in the same direction.

The precharge voltage unit 130 may include a plurality of switches SW1, SW2, . . . , SWj. The precharge voltage PV may be applied to first terminals of the switches SW1, SW2, SWj. Second terminals of the SW1, SW2, SWj may be coupled to the first through j-th data lines DL1 through DLj, respectively. The switches SW1, SW2, SWj may be turned on in accordance with the rising edge of the precharge control signal PCS, and may provide the precharge voltage PV to the first through j-th data lines DL1 through DLj.

As illustrated in FIG. 7, the precharge control signal PCS and the source output enable signal SOE may be substantially identical signals having the same period. That is, the precharge control signal PCS and the source output enable signal SOE may be signals having the same pulse every first horizontal period 1H. The precharge voltage unit 130 may output the precharge voltage PV to the first through j-th data lines DL1 through DLj included in the first pixel column block 111 in accordance with the rising edge of the precharge control signal PCS, and the data driving unit 140 may output the data voltages D1 through Dj to the first through j-th data lines DL1 through DLj, respectively, in accordance with the falling edge of the source output enable signal SOE. The first through j-th data lines DL1 through DLj may receive the precharge voltage PV ahead of (or before) the first through j-th data voltages D1 through Dj, and as a result, the pixels PX included in the first pixel column block 111 may be selectively charged in advance by as much as the precharge voltage PV.

An organic light-emitting display device according to another example embodiment of the invention will be described hereinafter with reference to FIGS. 8 and 9. The example embodiment of FIGS. 8 and 9 will be described hereinafter, focusing mainly on differences with the example embodiment of FIGS. 1 to 7.

Figure 8:
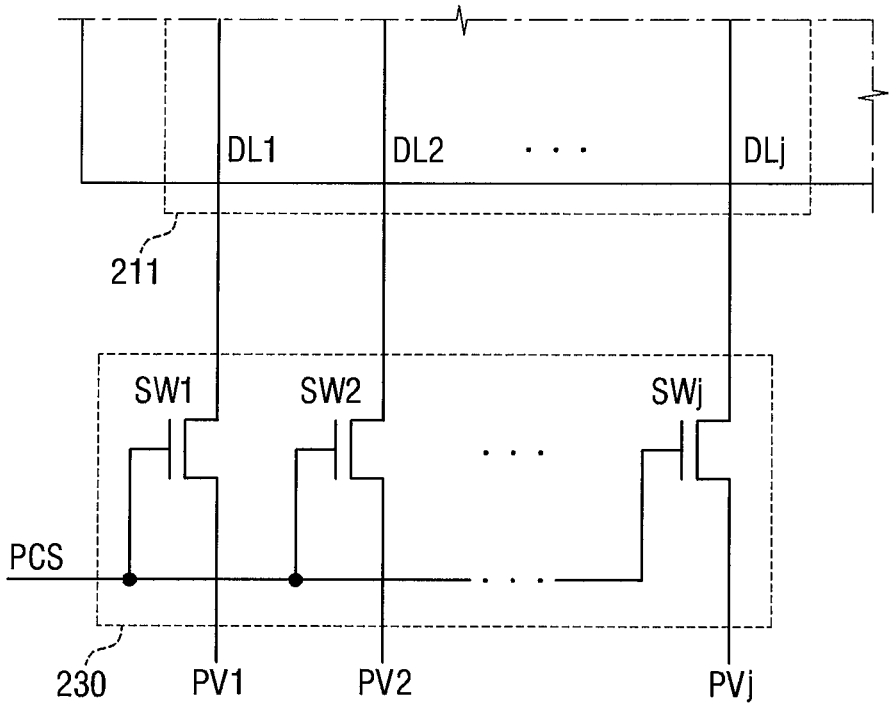
FIG. 8 is a circuit diagram illustrating a precharge voltage unit according to another example embodiment of the present invention.
Figure 9:
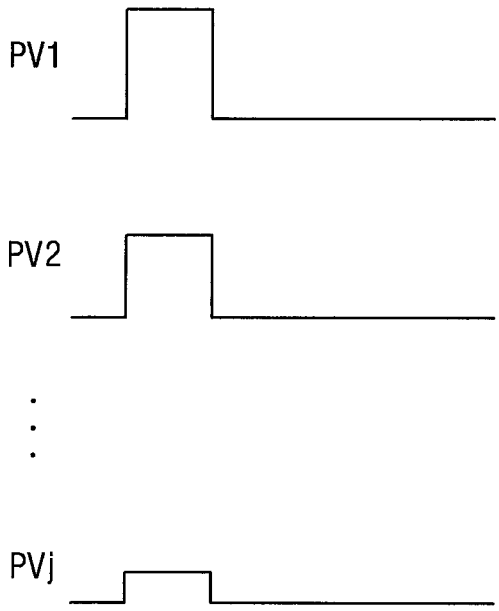
FIG. 9 is a waveform diagram illustrating a plurality of precharge voltages that can be provided by the precharge voltage unit of FIG. 8, according to an example embodiment of the present invention.

FIG. 8 is a circuit diagram illustrating a precharge voltage unit according to another example embodiment of the invention, and FIG. 9 is a waveform diagram illustrating a plurality of precharge voltages that can be provided by the precharge voltage unit of FIG. 8, according to an example embodiment of the invention.

Referring to FIGS. 8 and 9, a precharge voltage unit 230 may provide a plurality of first through j-th precharge voltages PV1 through PVj to a plurality of first through j-th data lines DL1 through DLj, respectively, which are included in a first pixel column block 211. The level of each precharge voltage provided by the precharge voltage unit 230 may decrease at a predetermined rate along a direction of the application of a scan signal. That is, the second precharge voltage PV2 may be lower than the first precharge voltage PV1, and the j-th precharge voltage PVj may be a lowest voltage. A voltage generation unit may provide the first through j-th precharge voltages PV1 through PVj, which have different levels from one another, to the precharge voltage unit 230. The first through j-th precharge voltages PV1 through PVj may be provided to the first through j-th data lines DL1 through DLj, respectively, via a plurality of first through j-th switches SW1 through SWj, respectively, of the precharge voltage unit 230.

An RC delay may occur due to the resistance of a plurality of scan lines included in the first pixel column block 211. A pixel near a scan driving unit and a pixel not near the scan driving unit may require different levels of precharge voltages to improve their respective data charging properties. That is, a pixel near the scan driving unit may need a higher precharge voltage than a pixel not near the scan driving unit. Accordingly, the first data line DL1, which is coupled to a column of pixels nearest to the scan driving unit, may be provided with a highest precharge voltage, e.g., the first precharge voltage PV1, and the j-th data line DLj, which is coupled to a column of pixels farthest from the scan driving unit, may be provided with a lowest precharge voltage, e.g., the j-th precharge voltage PVj. In the example embodiment of FIGS. 8 and 9, the precharge voltage unit 230 can efficiently provide more than precharge voltage in consideration of the data charging properties of pixels.

An organic light-emitting display device according to another example embodiment of the invention will be described hereinafter with reference to FIGS. 10 and 11. The example embodiment of FIGS. 10 and 11 will be described hereinafter, focusing mainly on differences with the example embodiment of FIGS. 1 to 7 or the example embodiment of 8 and 9.

Figure 10:
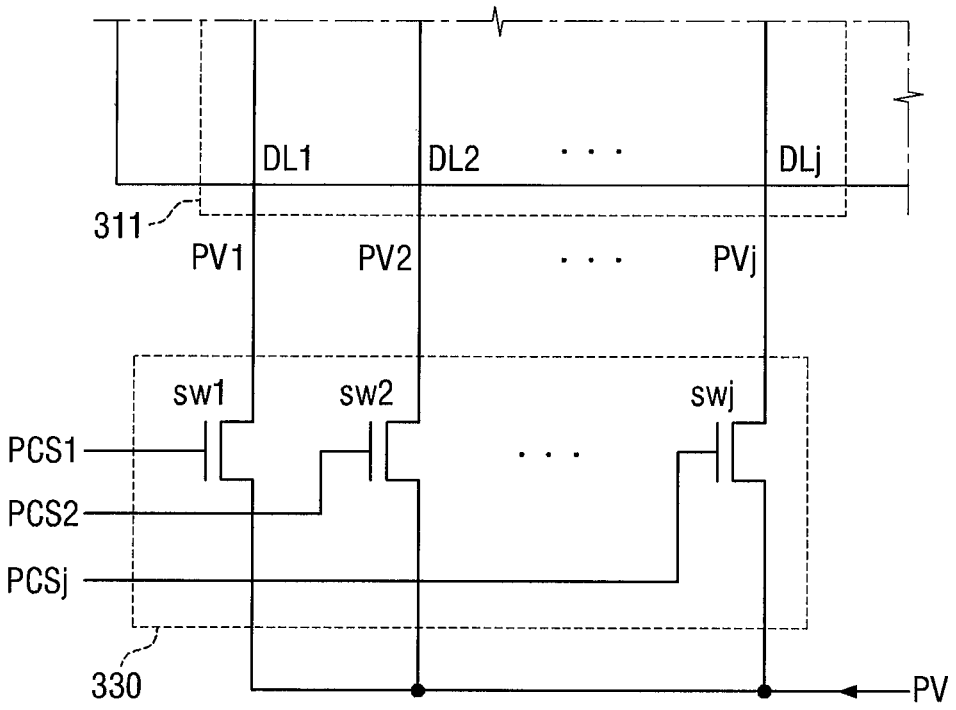
FIG. 10 is a circuit diagram illustrating a precharge voltage unit according to another example embodiment of the present invention.
Figure 11:
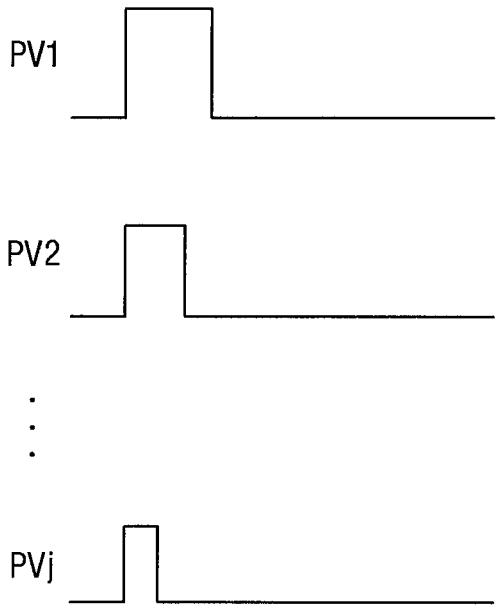
FIG. 11 is a waveform diagram illustrating a plurality of precharge voltages that can be provided by the precharge voltage unit of FIG. 10, according to an example embodiment of the present invention.

FIG. 10 is a circuit diagram illustrating a precharge voltage unit according to another example embodiment of the invention, and FIG. 11 is a waveform diagram illustrating a plurality of precharge voltages that can be provided by the precharge voltage unit of FIG. 10, according to an example embodiment of the invention.

Referring to FIGS. 10 and 11, a precharge voltage unit 330 may provide a plurality of first through j-th precharge voltages PV1 through PVj to a plurality of first through j-th data lines DL1 through DLj, respectively, which are included in a first pixel column block 311. The duration of the provision of each precharge voltage by the precharge voltage unit 330 may decrease at a predetermined rate along a direction of the application of a scan signal. That is, the second precharge voltage PV2 may be applied for a shorter period of time than the first precharge voltage PV1, and the j-th precharge voltage PVj may be applied for a shortest period of time. A voltage generation unit may provide the first through j-th precharge voltages PV1 through PVj, which have different pulse widths from one another, to the precharge voltage unit 330. The precharge voltage unit 330 may include a plurality of first through j-th switches SW1 through SWj, which are controlled by a plurality of first through j-th precharge control signals PCS1 through PCSj. The first precharge control signal PCS1 has a largest pulse width, and the j-th precharge control signal PCSj may have a smallest pulse width. That is, the pulse width of each precharge control signal may decrease at a predetermined rate from that of the first precharge control signal PCS1 to that of the j-th precharge control signal PCSj, and as a result, the duration of the provision of each precharge voltage by the precharge voltage unit 330 may decrease at a predetermined rate along a direction from the first data line DL1 to the j-th data line DLj.

An RC delay may occur due to the resistance of a plurality of scan lines included in the first pixel column block 311. A pixel near a scan driving unit and a pixel not near the scan driving unit may require different levels of precharge voltages to improve their respective data charging properties. That is, a pixel near the scan driving unit may need a higher precharge voltage than a pixel not near the scan driving unit. Accordingly, the first data line DL1, which is coupled to a column of pixels nearest to the scan driving unit, may be provided with the first precharge voltage PV1, which is applied for a longest period of time, and the j-th data line DLj, which is coupled to a column of pixels farthest from the scan driving unit, may be provided with the j-th precharge voltage PVj, which is applied for a shortest period of time. In the example embodiment of FIGS. 10 and 11, the precharge voltage unit 330 can efficiently provide more than precharge voltage in consideration of the data charging properties of pixels.

An organic light-emitting display device according to another example embodiment of the invention will be described hereinafter with reference to FIGS. 12 and 13. The example embodiment of FIGS. 12 and 13 will be described hereinafter, focusing mainly on differences with the example embodiment of FIGS. 1 to 7, the example embodiment of 8 and 9, and/or the example embodiment of FIGS. 10 and 11.

Figure 12:
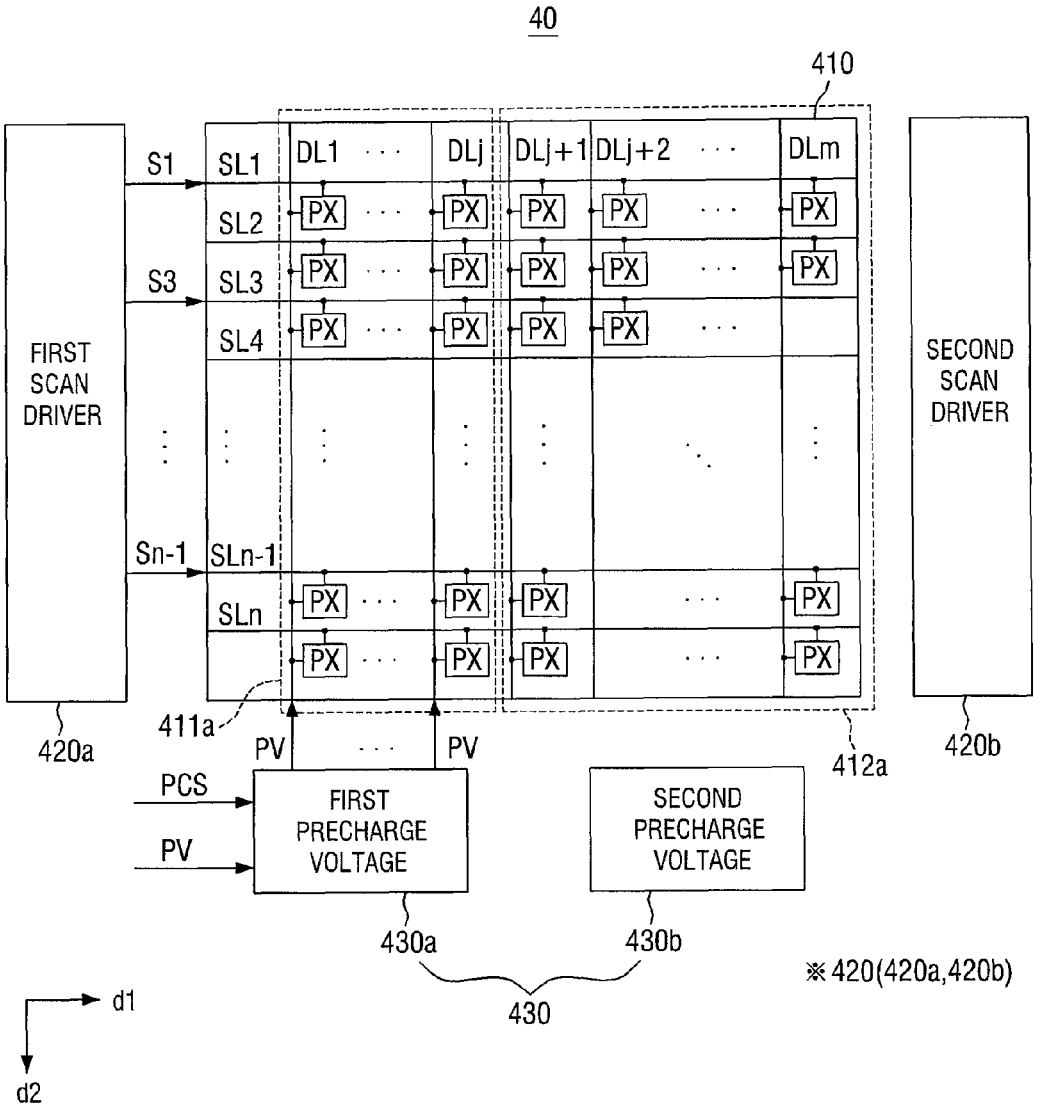
FIGS. 12 and 13 are block diagrams illustrating an organic light-emitting display device according to another example embodiment of the present invention.
Figure 13:
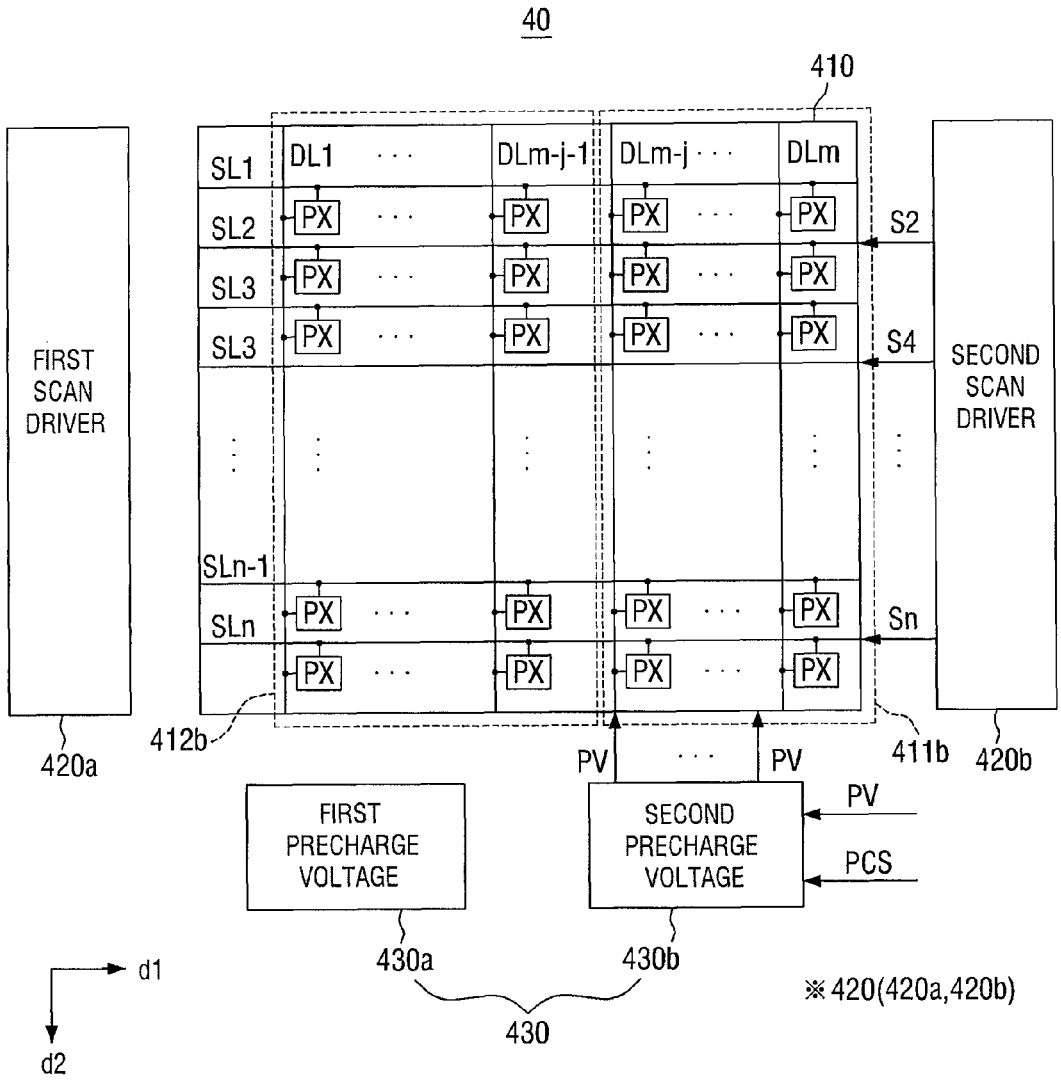

FIGS. 12 and 13 are block diagrams illustrating an organic light-emitting display device according to another example embodiment of the invention.

Referring to FIGS. 12 and 13, an organic light-emitting display device 40 may include a display unit 410, and the display unit 410 may include a plurality of scan lines S1, S2, . . . , Sn. The organic light-emitting display device 40 may also include a scan driving unit 420, and the scan driving unit 420 may include a first scan driver 420*a* and a second scan driver 420*b*. The first scan driver 420*a* and the second scan driver 420 may be located on the left and right sides, respectively, of the display unit 410 or at the top and the bottom, respectively, of the display unit 410. The first scan driver 420*a* may provide scan signals S1, S3, . . . , Sn−1 to the odd-numbered scan lines S1, S3, . . . , Sn−1, respectively, and the second scan driver 420*b* may provide scan signals S2, S4, . . . , Sn to the even-numbered scan lines S1, S2, . . . , Sn, respectively. The first scan driver 420*a* and the second scan driver 420*b* may be alternately activated. For example, the first scan driver 420*a* and the second scan driver 420*b* may be alternately activated at intervals of a frame. That is, as illustrated in FIG. 12, in a current frame, the first scan driver 420*a* may be activated, and may thus provide the scan signals S1, S3, . . . , Sn−1 to the odd-numbered scan lines S1, S3, . . . , Sn−1, respectively. As illustrated in FIG. 13, in a subsequent frame, the second scan driver 420*b* may be activated, and may thus provide the scan signals S2, S4, . . . , Sn to the even-numbered scan lines S2, S4, . . . , Sn, respectively. The organic light-emitting display device 40 may adopt an interlaced scanning method in which a plurality of scan drivers are driven one after another at intervals of a frame. A pixel column block 411*a* or 411*b* of the display unit 410 may be set as a first pixel column block. The first pixel column block may be defined as a pixel column block including a pixel PX receiving a scan signal ahead of other pixels PX, and may thus be set differently depending on whether the first scan driver 420*a* or the second scan driver 420*b* is activated. For example, in response to the first scan driver 420*a* being activated, the pixel column block 411 a, including first to j-th data lines DL1 through DLJ, may be set as the first pixel column block. In response to the second scan driver 420*b* being activated, the pixel column block 411*b*, including (m−j)-th to m-th data lines DLm−j to DLm, may be set as the first pixel column block. However, the invention is not limited to the example embodiment of FIGS. 12 and 13.

The organic light-emitting display device 40 may also include a precharge voltage unit 430, and the precharge voltage unit 430 may include a first precharge voltage 430*a* and a second precharge voltage 430*b*. The first precharge voltage 430*a* may be activated when the first scan driver 420*a* is activated, and the second precharge voltage 430*b* may be activated when the second scan driver 420*b* is activated. In response to the first scan driver 420*a* being activated, the first precharge voltage 430*a* may receive a precharge control signal PCS from a timing control unit, and may receive a precharge voltage PV from a voltage generation unit. The first precharge voltage 430*a* may provide the precharge voltage to each pixel PX included in the pixel column block 411*a*, which is currently being set as the first pixel column block. On the other hand, in response to the second scan driver 420*b* being activated, the second precharge voltage 430*a* may receive the precharge control signal PCS from the timing control unit, and may receive the precharge voltage PV from the voltage generation unit. The second precharge voltage 430*b* may provide the precharge voltage to each pixel PX included in the pixel column block 411*b*, which is currently being set as the first pixel column block.

In the example embodiment of FIGS. 12 and 13, as a scanning direction varies according to a predetermined schedule, the organic light-emitting display device 40 may set a first pixel column block differently, and may selectively provide the precharge voltage PV to the first pixel column block, thereby effectively reducing its power consumption.

An organic light-emitting display device according to another example embodiment of the invention will be described hereinafter with reference to FIG. 14.

Figure 14:
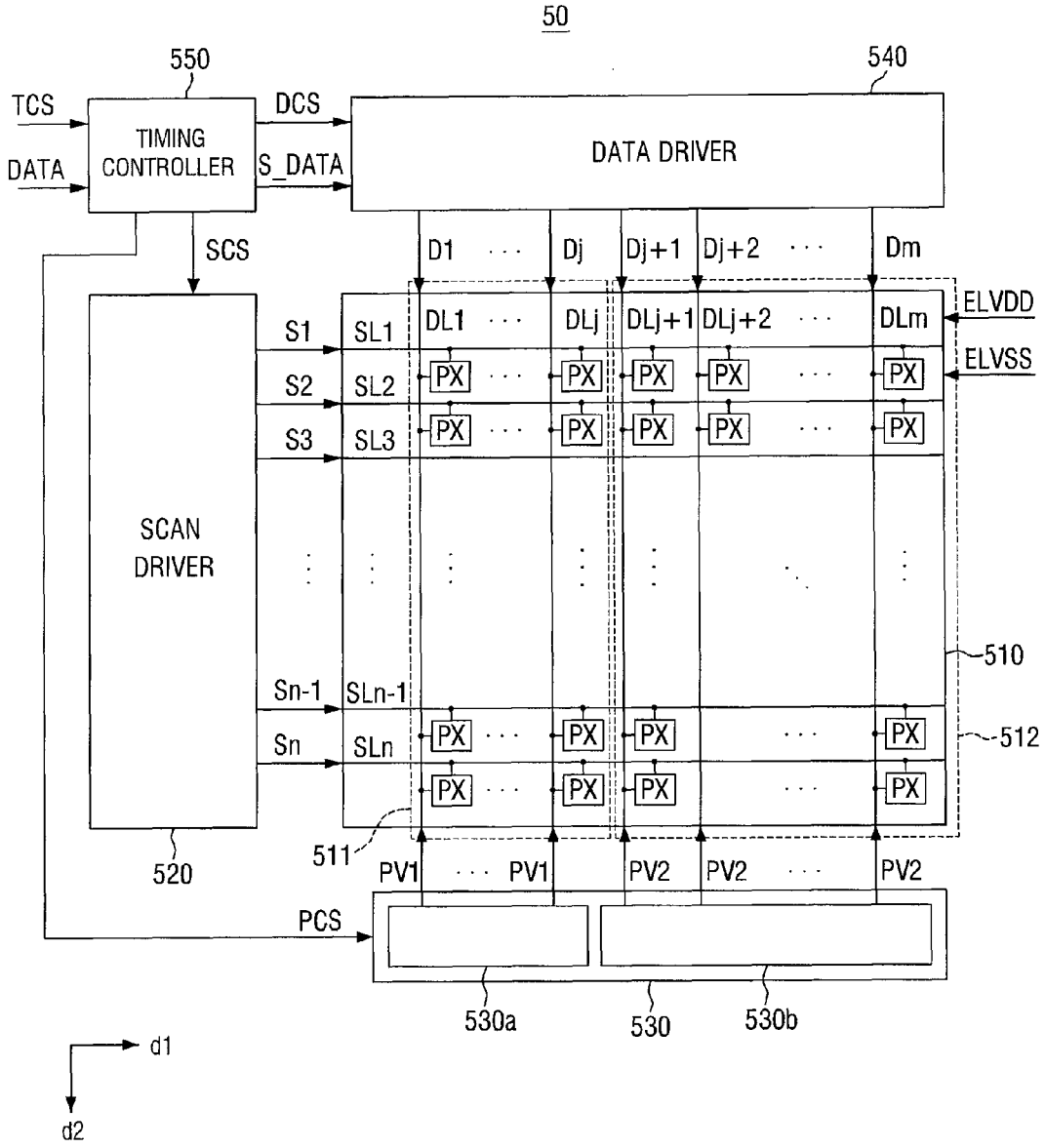
FIG. 14 is a block diagram illustrating an organic light-emitting display device according to another example embodiment of the present invention.

FIG. 14 is a block diagram illustrating an organic light-emitting display device according to another example embodiment of the invention.

Referring to FIG. 14, an organic light-emitting display device 50 includes a display unit 510, a scan driving unit 520 and a precharge voltage unit 530.

The organic light-emitting display device 50 may be driven by a digital driving method in which a frame is divided into a plurality of sub-frames and a grayscale is represented based on the sum of the lengths of one or more sub-frames during which light is emitted. The driving method of the organic light-emitting display device 50 is substantially the same as the driving method of the organic light-emitting display device 10 of FIGS. 1 to 7, and thus, a detailed description thereof will be omitted.

The display unit 510 may be a region where images are displayed. The display unit 510 may include a plurality of pixels PX arranged in a matrix, a plurality of scan lines SL1, SL2, . . . , SLn, and a plurality of data lines DL1, DL2, . . . , DLm intersecting the scan lines SL1, SL2, . . . , SLn so as to define the pixels PX. Each of the pixels may be coupled to one of the scan lines SL1, SL2, . . . , SLn and one of the data lines DL1, DL2, . . . , DLm. Each of the pixels PX may receive one of a plurality of scan signals S1, S2, . . . , Sn from one of the scan lines SL1, SL2, . . . , SLn coupled thereto and may receive one of a plurality of data voltages D1, D2, . . . , Dm from one of the data lines DL1, DL2, . . . , DLm coupled thereto in response to the receipt of one of the scan signals S1, S2, . . . , Sn. Each of the pixels PX may be provided with a first power voltage ELVDD via a first power line, and may be provided with a second power voltage ELVSS via a second power line.

The scan driving unit 520 may provide the scan signals SL1, SL2, . . . , SLn to the scan lines SL1, SL2, . . . , SLn, respectively, of the display unit 510 during each sub-frame period. Each of the scan signals S1, S2, . . . , Sn may include a scan-on period providing a scan-on voltage Son with a first level, and a scan-off period providing a scan-off voltage Soff with a second level. Because the scan signals S1, S2, . . . , Sn are provided in each sub-frame period, which is relatively short, the scan-on periods of the scan signals S1, S2, . . . , Sn may be very short.

The precharge voltage unit 530 may provide a first precharge voltage PV1 and a second precharge voltage PV2 to the pixels PX. The first precharge voltage PV1 or the second precharge voltage PV2 may be provided, ahead of the data voltages D1 through Dm, to the data lines DL1 through DLm so that the data lines DL1 through DLm can be precharged. Accordingly, it is possible to reduce the occurrence of an "RC delay" phenomenon in which the pixels PX are not sufficiently charged with the data voltages D1, D2, . . . , Dm during the short scan-on period of each sub-frame. The precharge voltage unit 530 may include a first precharge voltage unit 530*a* and a second precharge voltage unit 530*b*. The first precharge voltage unit 530*a* and the second precharge voltage unit 530*b* may provide the first precharge voltage PV1 and the second precharge voltage PV2, respectively, and the first precharge voltage PV1 may be relatively higher than the second precharge voltage PV2.

The pixels PX of the display unit 510 may be divided into a first pixel column block 511 and a second pixel column block 512. The first pixel column block 511 and the second pixel column block 512 may be arranged side-by-side in a direction in which the scan signals S1, S2, . . . , Sn are transmitted. The second pixel column block 512 may be arranged next to the first pixel column block 511. The first pixel column block 511 may receive the scan signals S1, S2, . . . , Sn earlier than the second pixel column block 512, and may be arranged near (or relatively nearer) the scan driving unit 520. The first pixel column block 511 may include a pixel PX which receives a scan signal ahead of other pixels PX, e.g., a pixel PX belonging to a first row and a first column of the matrix of the pixels PX. In an example embodiment, the first pixel column block 511 may include first through j-th columns of pixels PX, which are coupled to the first through j-th data lines DL1 through DLj, respectively, and the second pixel column block 512 may include the (j+1)-th through m-th columns of pixels PX, which are coupled to the (j+1)-th through m-th data lines DLj+1 through DLm, respectively. However, the present invention is not limited to this example embodiment. The precharge voltage unit 530 may provide the first precharge voltage PV1 to the first pixel column block 511 and may provide the second precharge voltage PV2 to the second pixel column block 512.

The second pixel column block 512 is relatively apart (or farther compared to the first pixel column block 511) from the scan driving unit 520. Accordingly, in the second pixel column block 512, unlike in the first pixel column block 511, an RC delay in the transmission of the scan signals S1, S2, . . . , Sn may occur due to the resistance of the scan lines SL1 through SLn. That is, because not only an RC delay in the transmission of the scan signals S1, S2, . . . , Sn, but also an RC delay in the transmission of the data voltages D1, D2, . . . , Dm, which is caused due to the resistance of the data lines DL1, DL2, . . . , DLm, occurs in the second pixel column block 512, the quality of display may not deteriorate much in the second pixel column block 512. The second precharge voltage PV2, which is for improving the quality of display in the second pixel column block 512, may be lower than the first precharge voltage PV1, which is for improving the quality of display in the first pixel column block 511.

The organic light-emitting display device 50 can provide different (or suitable) precharge voltages to different parts of the display unit 510, and can thus reduce its power consumption.

In an example embodiment, the scan driving unit 520 may include a first scan driver providing the scan signals S1, S3, . . . , Sn−1 to the odd-numbered scan lines S1, S3, . . . , Sn−1, respectively, and a second scan driver providing the scan signals S2, S4, . . . , Sn to the even-numbered scan lines S1, S2, . . . , Sn, respectively. The first scan driver and the second scan driver may be alternately activated, and may apply scan signals in opposite directions. The first scan driver and the second scan driver may be alternately activated at intervals of a predetermined period, for example, a frame. In this example embodiment, the first pixel column block 511, which is a pixel column block including a pixel PX receiving a scan signal ahead of (or before) other pixels PX, and the second pixel column block 512 may be reset depending on which of the first scan driver and the second scan driver is activated, and the first precharge voltage unit 530*a* and the second precharge voltage unit 530*b* may provide the first precharge voltage PV1 and the second precharge voltage PV2 to reset the first and second pixel column blocks 511 and 512, respectively.

In an example embodiment, the first precharge voltage unit 530*a* may provide different first precharge voltages PV1 to the first through m-th data lines DL1 through DLm included in the first pixel column block 511. In this example embodiment, the duration of the provision of each first precharge voltage PV1 may be set, in consideration of an RC delay in the transmission of the scan signals S1, S2, . . . , Sn that may occur due to the resistance of the scan lines SL1, SL2, . . . , SLn, to decrease at a predetermined rate along a direction of the application of the scan signals S1, S2, . . . , Sn. Accordingly, pixels PX close to the scan driving unit 520 can become more precharged than pixels PX distant from the scan driving unit 520.

In an example embodiment, the level of each first precharge voltage PV1 may be set to decrease at a predetermined rate along a direction of the application of the scan signals S1, S2, . . . , Sn. In this example embodiment, a minimum first precharge voltage PV1 may still be higher than a second precharge voltage PV2. For example, a higher first precharge voltage PV1 may be provided to a row of pixels PX near the scan driving unit 520 than to a row of pixels PX distant from the scan driving unit 520 in consideration of an RC delay in the transmission of the scan signals S1, S2, . . . , Sn that may occur due to the resistance of the scan lines SL1, SL2, . . . , SLn. That is, different first precharge voltages PV1 may be provided to different rows of pixels PX in the first pixel column block 511 in consideration of the charging properties of the different rows of pixels PX.

An organic light-emitting display device according to another example embodiment of the invention will hereinafter be described with reference to FIGS. 15 to 17.

Figure 15:
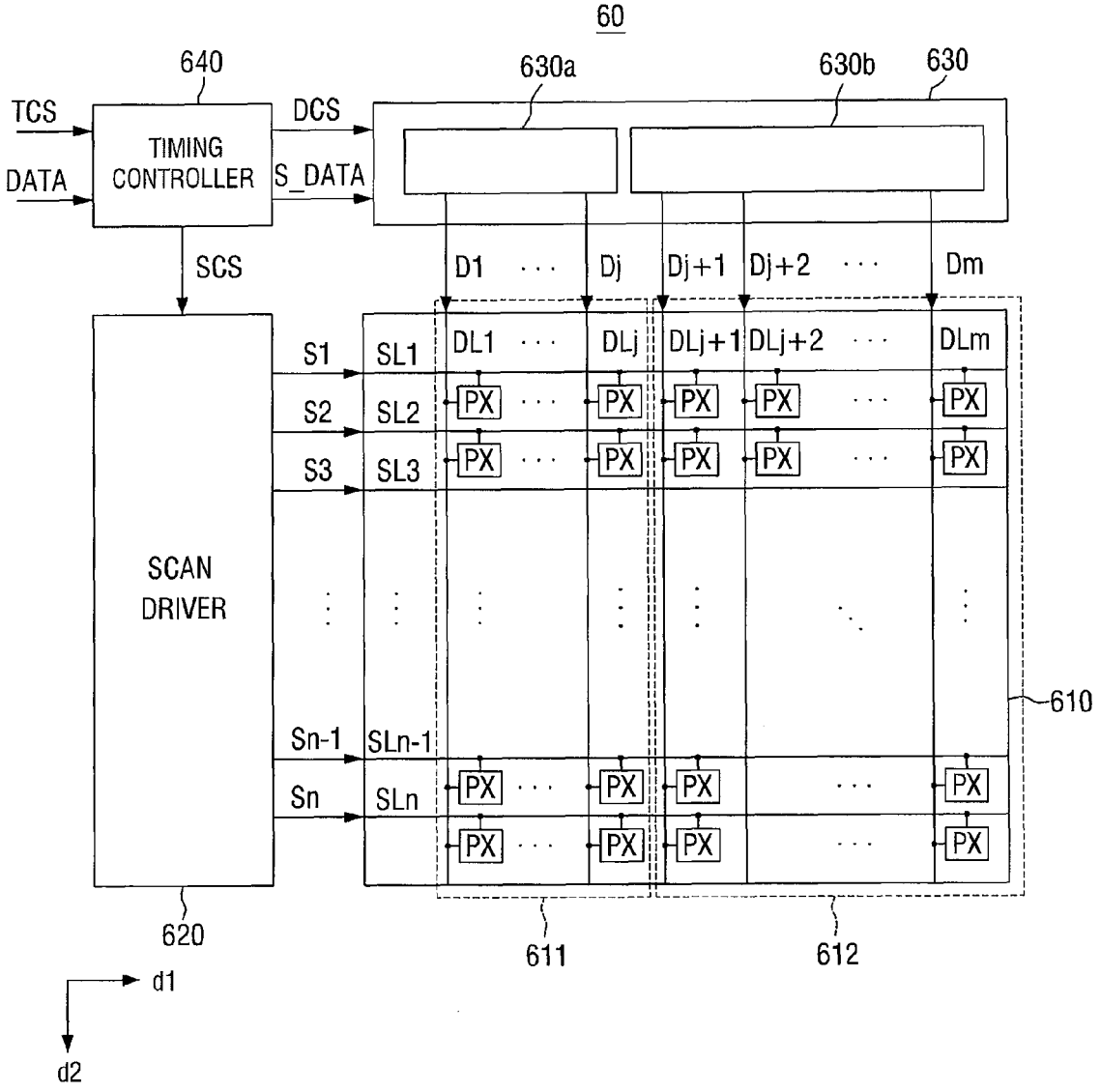
FIG. 15 is a block diagram illustrating an organic light-emitting display device according to another example embodiment of the present invention.
Figure 16:
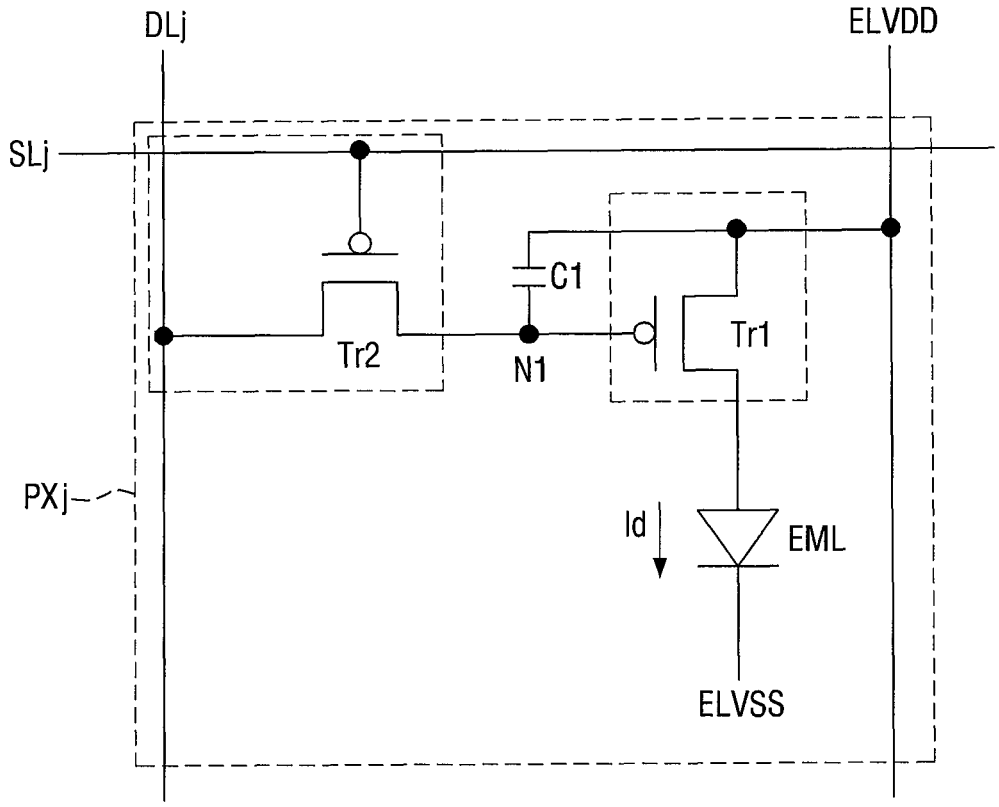
FIG. 16 is a circuit diagram illustrating a pixel.
Figure 17:
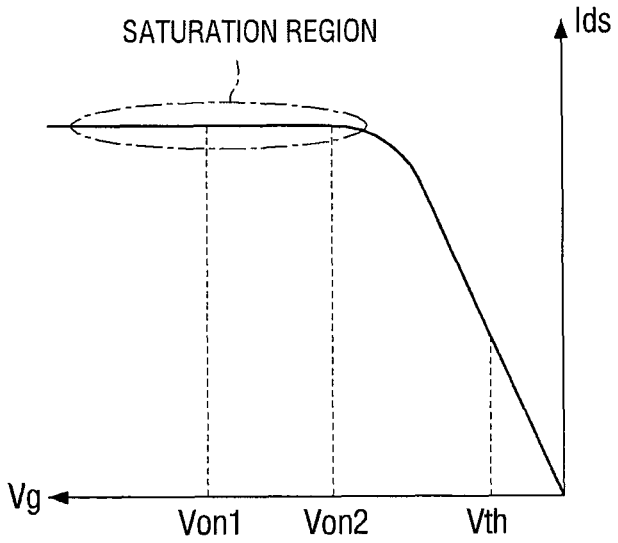
FIG. 17 is a graph illustrating the relationship between the gate voltage of a driving transistor and a current flown into an organic light-emitting element.

FIG. 15 is a block diagram illustrating an organic light-emitting display device according to another example embodiment of the invention, FIG. 16 is a circuit diagram illustrating a pixel, and FIG. 17 is a graph illustrating the relationship between the gate voltage of a driving transistor and a current flown into an organic light-emitting element.

Referring to FIGS. 15 to 17, an organic light-emitting display device 60 includes a display unit 610, a scan driving unit 620 and a precharge voltage unit 630.

The organic light-emitting display device 60 may be driven by a digital driving method in which a frame is divided into a plurality of sub-frames and a grayscale is represented based on the sum of the lengths of one or more sub-frames during which light is emitted. The driving method of the organic light-emitting display device 60 is substantially the same as the driving method of the organic light-emitting display device 10 of FIGS. 1 to 7, and thus, a detailed description thereof will be omitted.

The display unit 610 may be a region where images are displayed. The display unit 610 may include a plurality of pixels PX arranged in a matrix, a plurality of scan lines SL1, SL2, . . . , SLn, and a plurality of data lines DL1, DL2, . . . , DLm intersecting the scan lines SL1, SL2, . . . , SLn so as to define the pixels PX. Each of the pixels may be coupled to one of the scan lines SL1, SL2, . . . , SLn and one of the data lines DL1, DL2, . . . , DLm. Each of the pixels PX may receive one of a plurality of scan signals S1, S2, . . . , Sn from one of the scan lines SL1, SL2, . . . , SLn coupled thereto and may receive one of a plurality of data voltages D1, D2, . . . , Dm from one of the data lines DL1, DL2, . . . , DLm coupled thereto in response to the receipt of one of the scan signals S1, S2, . . . , Sn. Each of the pixels PX may be provided with a first power voltage ELVDD via a first power line, and may be provided with a second power voltage ELVSS via a second power line.

Each of the pixels PX may include an organic light-emitting element, a driving transistor driving the organic light-emitting element, and a control transistor controlling the driving transistor, wherein the gate terminal of the control transistor may be coupled to one of the scan lines SL1, SL2, . . . , SLn, and the source terminal of the control transistor may be coupled to one of the data lines DL1, DL2, . . . , DLm. FIG. 16 illustrates an example circuit diagram of a pixel PXj coupled to a j-th scan line SLj and a j-th data line DLj, but the invention is not limited to the structure of the pixel PXj. Referring to the pixel PXj of FIG. 16, the drain terminal of a control transistor Tr2 may be coupled to the gate terminal of a driving transistor Tr1. That is, in response to receipt of a j-th scan signal Sj, the control transistor Tr2 may be turned on, and as a result, a data voltage Dj may be provided to the gate terminal of the driving transistor Tr1 via the turned-on control transistor Tr2. The data voltage Dj may be a gate voltage Vg of the turned-on driving transistor Tr1. The drain terminal of the driving transistor Tr1 may be coupled to a source of the first power voltage ELVDD, and the source terminal of the driving transistor Tr1 may be coupled to an organic light-emitting element EML. A current Id may be generated in the channel of the driving transistor Tr1 according to the relationship between the data voltage Dj applied to the driving transistor Tr1 and a source-drain voltage of the driving transistor Tr1. The current Id may be a driving current causing the organic light-emitting element EML to emit light.

The scan driving unit 620 may provide the scan signals SL1, SL2, . . . , SLn to the scan lines SL1, SL2, . . . , SLn, respectively, of the display unit 610 during each sub-frame period. Each of the scan signals S1, S2, . . . , Sn may include a scan-on period providing a scan-on voltage Son with a first level, and a scan-off period providing a scan-off voltage Soff with a second level. Because the scan signals S1, S2, . . . , Sn are provided in each sub-frame period, which is relatively short, the scan-on periods of the scan signals S1, S2, . . . , Sn may be very short.

The data driving unit 630 may provide the data voltages D1, D2, . . . Dm to the data lines DL1, DL2, . . . , DLm, respectively, of the display unit 610. Since the organic light-emitting display device 60 is driven by a digital driving method, the data voltages D1, D2, . . . , Dm may be digital signals transmitting a data vale of "1" or "0". That is, each of the data voltages D1, D2, . . . , Dm may be an "on" voltage that corresponds to a data value of "1" and can turn on a driving transistor, or may be an "off" voltage that corresponds to a data value of "0" and can turn off a driving transistor. In response to a driving transistor being turned on, a gate voltage Vg (e.g., a data voltage) higher than a threshold voltage Vth of the driving transistor may be applied to the gate terminal of the driving transistor. Accordingly, in response to the "on" voltage being applied to the gate terminal of a driving transistor as a data voltage, an organic light-emitting element EML may emit light during a corresponding sub-frame period. However, in response to the "off" voltage being applied to the gate terminal of a driving transistor as a data voltage, an organic light-emitting element EML may not emit light during a corresponding sub-frame period.

The "on" voltage may be a voltage corresponding to a saturation region of a driving transistor. That is, in the saturation region, the luminance of an organic light-emitting element may no longer change regardless of whether the gate voltage Vg increases any further. That is, in a digital driving method, a grayscale is represented based on the sum of the lengths of the periods for which a predetermined luminance level is provided, instead of based on luminance variations.

The pixels PX of the display unit 610 may be divided into a first pixel column block 611 and a second pixel column block 612. The first pixel column block 611 and the second pixel column block 612 may be arranged side-by-side in a direction in which the scan signals S1, S2, . . . , Sn are transmitted. The second pixel column block 612 may be arranged next to the first pixel column block 611. The first pixel column block 611 may receive the scan signals S1, S2, . . . , Sn earlier than the second pixel column block 612, and may be disposed near the scan driving unit 620. The first pixel column block 611 may include a pixel PX which receives a scan signal ahead of other pixels PX, e.g., a pixel PX belonging to a first row and a first column of the matrix of the pixels PX. In an example embodiment, the first pixel column block 611 may include first through j-th columns of pixels PX, which are coupled to the first through j-th data lines DL1 through DLj, respectively, and the second pixel column block 612 may include the (j+1)-th through m-th columns of pixels PX, which are coupled to the (j+1)-th through m-th data lines DLj+1 through DLm, respectively. However, the invention is not limited to this example embodiment.

The second pixel column block 612 is relatively apart from the scan driving unit 620. Accordingly, in the second pixel column block 612, unlike in the first pixel column block 611, an RC delay in the transmission of the scan signals S1, S2, . . . , Sn may occur due to the resistance of the scan lines SL1 through SLn. That is, since not only an RC delay in the transmission of the scan signals S1, S2, . . . , Sn, but also an RC delay in the transmission of the data voltages D1, D2, . . . , Dm, which is caused due to the resistance of the data lines DL1, DL2, . . . , DLm, occurs in the second pixel column block 612, the quality of display may not much deteriorate in the second pixel column block 612.

On the other hand, the first pixel column block 611 is disposed near the scan driving unit 620. Accordingly, almost no RC delay may occur in the transmission of the scan signals S1, S2, . . . , Sn regardless of the resistance of the scan lines SL1, SL2, . . . , SLn. However, a data voltage charging delay may occur in the first pixel column block 611, and may thus deteriorate the quality of display in the first pixel column block 611.

The data driving unit 630 may include a first data driver 630*a* and a second data driver 630*b*. The first data driver 630*a* and the second data driver 630*b* may be provided as independent drive ICs, but the invention is not limited thereto. The first data driver 630*a* may provide a first "on" voltage Von1 with a first level to each of the first through j-th data lines DL1 through DL1 as a data voltage, and the second data driver 630*b* may provide a second "on" voltage Von2 with a second level, which is lower than the first level, to each of the (j+1)-th through m-th data lines DLj+1 through DLm as a data voltage. That is, the first data driver 630*a* may provide the first "on" voltage Von1 to the pixels PX in the first pixel column block 611. The luminance of light emitted by an organic light-emitting element in response to the application of the first "on" voltage Von1 may be substantially the same as the luminance of light emitted by an organic light-emitting element in response to the application of the second "on" voltage Von2, but the pixels PX in the first pixel column block 611 can be more easily charged than the pixels PX in the second pixel column block 612 because of the first "on" voltage Von1 being higher the second "on" voltage Von2. That is, by applying a higher data voltage to the first pixel column block 611 than to the second pixel column block 612, it is possible to offer the same effect of precharging the pixels PX in the first pixel column block 611. Accordingly, a data voltage charging delay in the first pixel column block 611 may be improved, and as a result, the deterioration of the quality of display in the first pixel column block 611 may be addressed. Also, by selectively providing the first "on" voltage Von1 only to the first pixel column block 611, the power consumption of the organic light-emitting display device 60 may be minimized.

In an example embodiment, the scan driving unit 620 may include a first scan driver (not illustrated) providing the scan signals S1, S3, . . . , Sn−1 to the odd-numbered scan lines S1, S3, . . . , Sn−1, respectively, and a second scan driver (not illustrated) providing the scan signals S2, S4, . . . , Sn to the even-numbered scan lines S1, S2, . . . , Sn, respectively. The first scan driver and the second scan driver may be alternately activated, and may apply scan signals in opposite directions. The first scan driver and the second scan driver may be alternately activated at intervals of a predetermined period, for example, a frame. In this example embodiment, the first pixel column block 611, which is a pixel column block including a pixel PX receiving a scan signal ahead of other pixels PX, and the second pixel column block 612 may be reset depending on which of the first scan driver and the second scan driver is activated, and the data driving unit 630 may provide the first "on" voltage Von1 to the reset first pixel column block 611.

In an example embodiment, the level of the first "on" voltage Von1 may be set to decrease at a predetermined rate along a direction of the application of the scan signals S1, S2, . . . , Sn. In this example embodiment, a minimum level of the first "on" voltage Von1 may still be higher than the second "on" voltage Von2. More specifically, a higher first "on" voltage Von1 may be provided to a row of pixels PX near the scan driving unit 620 than to a row of pixels PX distant from the scan driving unit 620 in consideration of an RC delay in the transmission of the scan signals S1, S2, . . . , Sn that may occur due to the resistance of the scan lines SL1, SL2, . . . , SLn. That is, different first "on" voltages Von1 may be provided to different rows of pixels PX in the first pixel column block 611 in consideration of the charging properties of the different rows of pixels PX.

While the invention has been particularly shown and described with reference to example embodiments thereof, it will be understood by those of ordinary skill in the art that various changes in the provided detail may be made therein without departing from the spirit and scope of the invention as defined by the following claims. The example embodiments should be considered in a descriptive sense only and not for purposes of limitation. It is therefore desired that the present embodiments be considered in all respects as illustrative and not restrictive, with reference being made to the appended claims and their equivalents.

What is claimed is:

1. An organic light-emitting display device which divides each frame into a plurality of sub-frames and represents gray levels based on a sum of lengths of one or more of the plurality of sub-frames during which light is emitted, the organic light-emitting display device comprising:

a display unit comprising a plurality of pixels arranged in a matrix, the pixels being divided into a first pixel column block and a second pixel column block;

a scan driver configured to provide a scan signal to the display unit during each sub-frame period, the pixels of the first pixel column block being located closer to the scan driver than the pixels of the second pixel column block; and a precharge voltage unit coupled to the pixels of only the first pixel column block and configured as a voltage source to provide a precharge voltage to only the pixels of the first pixel column block.

2. The organic light-emitting display device of claim 1, wherein the first pixel column block comprises a plurality of scan lines extending in a first direction and configured to apply the scan signal to each of the pixels in the first pixel column block, and a plurality of data lines extending in a second direction crossing the first direction, and configured to transmit a data voltage to each of the pixels in the first pixel column block and the precharge voltage unit is configured to provide the precharge voltage to the data lines before the data voltage is applied to the data lines.

3. The organic light-emitting display device of claim 2, wherein the precharge voltage unit is further configured to provide different precharge voltages to the data lines.

4. The organic light-emitting display device of claim 3, wherein a duration of the precharge voltage provided to the data lines decreases at a predetermined rate along the first direction.

5. The organic light-emitting display device of claim 3, wherein the precharge voltage provided to the data lines decreases at a predetermined rate along the first direction.

6. The organic light-emitting display device of claim 1, wherein the display unit further comprises a plurality of scan lines, and the scan driver comprises a first scan driver configured to provide the scan signal to odd-numbered scan lines among the scan lines, and a second scan driver configured to provide the scan signal to even-numbered scan lines among the scan lines, and the first scan driver and the second scan driver are configured to be alternately activated and apply the scan signal in opposite directions.

7. The organic light-emitting display device of claim 6, wherein the precharge voltage unit comprises a first precharge voltage unit configured to provide the precharge voltage to pixels in the first pixel column block in response to the first scan driver being activated, and a second precharge voltage unit configured to provide the precharge voltage to pixels in the first pixel column block in response to the second scan driver being activated.

8. An organic light-emitting display device which divides each frame into a plurality of sub-frames and represents gray levels based on a sum of lengths of one or more of the plurality of sub-frames during which light is emitted, the organic light-emitting display device comprising:

a display unit comprising a plurality of pixels arranged in a matrix, the pixels being divided into a first pixel column block and a second pixel column block;

a scan driver configured to provide a scan signal to the display unit during each sub-frame period, the pixels of the first pixel column block being located closer to the scan driver than the pixels of the second pixel column block;

a first precharge voltage unit coupled to the pixels of only the first pixel column block and configured as a voltage source to provide a first precharge voltage to only the pixels of the first pixel column block; and a second precharge voltage unit coupled to the pixels of only the second pixel column block and configured as a voltage source to provide a second precharge voltage to only the pixels of the second pixel column block, the first precharge voltage being higher than the second precharge voltage.

9. The organic light-emitting display device of claim 8, wherein the scan driver comprises a first scan driver configured to provide the scan signal to odd-numbered scan lines and a second scan driver configured to provide the scan signal to even-numbered scan lines, and the first scan driver and the second scan driver are configured to be alternately activated and apply the scan signal in opposite directions.

10. The organic light-emitting display device of claim 9, wherein the first pixel column block and the second pixel column block are reset depending on which of the first scan driver and the second scan driver is activated, and the first precharge voltage unit is configured to provide the first precharge voltage and the second precharge voltage unit is configured to provide the second precharge voltage to reset the first and second pixel column blocks, respectively.

11. The organic light-emitting display device of claim 8, wherein the display unit further comprises a plurality of scan lines extending in a first direction and configured to apply the scan signal to each of the pixels in the first pixel column block, and a plurality of data lines extending in a second direction crossing the first direction, and configured to transmit a data voltage to each of the pixels in the first pixel column block and the first precharge voltage unit and the second precharge voltage unit are configured to provide the first precharge voltage and the second precharge voltage, respectively, to respective ones of the data lines before the data voltage is applied to the data lines.

12. The organic light-emitting display device of claim 11, wherein the first precharge voltage unit is configured to provide different first precharge voltages to data lines in the first pixel column block.

13. The organic light-emitting display device of claim 12, wherein a voltage level of each first precharge voltage provided to the data lines decreases at a predetermined rate along the first direction, and a lowest first precharge voltage is higher than the second precharge voltage.

14. The organic light-emitting display device of claim 12, wherein a duration of each precharge voltage provided to the data lines decreases at a predetermined rate along the first direction.

15. An organic light-emitting display device which divides each frame into a plurality of sub-frames and represents gray levels based on a sum of lengths of one or more of the plurality of sub-frames during which light is emitted, the organic light-emitting display device comprising:

a display unit comprising a plurality of pixels arranged in a matrix, each pixel of the pixels comprising an organic light-emitting element and a driving transistor configured to drive the organic light-emitting element, the pixels being divided into a first pixel column block and a second pixel column block;

a scan driver configured to provide a scan signal to the display unit during each sub-frame period, the pixels of the first pixel column block being located closer to the scan driver than the pixels of the second pixel column block;

a first data driver configured to provide a first ON voltage with a first voltage level to the pixels of the first pixel column block to turn on the driving transistors of the pixels of the first pixel column block; and a second data driver configured to provide a second ON voltage with a second voltage level to the pixels of the second pixel column block to turn on the driving transistors of the pixels of the second pixel column block, the second voltage level being lower than the first voltage level.

16. The organic light-emitting display device of claim 15, wherein the scan driver comprises a first scan driver configured to provide the scan signal to odd-numbered scan lines and a second scan driver configured to provide the scan signal to even-numbered scan lines, and the first scan driver and the second scan driver are configured to be alternately activated and apply the scan signal in opposite directions.

17. The organic light-emitting display device of claim 16, wherein the first pixel column block and the second pixel column block are reset depending on which of the first scan driver and the second scan driver is activated, and the first data driver and the second data driver are configured to provide the first ON voltage and the second ON voltage, respectively, to reset the first and second pixel column blocks, respectively.

18. The organic light-emitting display device of claim 15, wherein the first pixel column block comprises a plurality of scan lines extending in a first direction and is configured to apply the scan signal to each of the pixels included in the first pixel column block, and a plurality of data lines extending in a second direction, which crosses the first direction, and configured to transmit a data voltage to each of the pixels included in the first pixel column block.

19. The organic light-emitting display device of claim 18, wherein the first data driver is configured to provide different first ON voltages to the data lines.

20. The organic light-emitting display device of claim 19, wherein a voltage level of each first ON voltage decreases at a predetermined rate along the first direction, and a lowest first ON voltage is higher than a second precharge voltage.

* * * * *